US006860617B2

(12) United States Patent
Fiene

(10) Patent No.: US 6,860,617 B2
(45) Date of Patent: Mar. 1, 2005

(54) COMPACT LUMINAIRE

(75) Inventor: Dale E. Fiene, Algonquin, IL (US)

(73) Assignee: Ole K. Nilssen, Bonita Springs, FL (US)

( * ) Notice: Subject to any disclaimer, the term of this patent is extended or adjusted under 35 U.S.C. 154(b) by 160 days.

(21) Appl. No.: 10/197,141

(22) Filed: Jul. 16, 2002

(65) Prior Publication Data

US 2003/0002279 A1 Jan. 2, 2003

Related U.S. Application Data

(63) Continuation-in-part of application No. 09/507,020, filed on Feb. 22, 2000, which is a continuation-in-part of application No. 09/471,567, filed on Dec. 23, 1999, now Pat. No. 6,439,736, which is a continuation-in-part of application No. 09/444,182, filed on Nov. 19, 1999, now Pat. No. 6,435,693, which is a continuation-in-part of application No. 09/410,805, filed on Oct. 1, 1999, now Pat. No. 6,260,981.

(51) Int. Cl.[7] ..... F21S 8/00

(52) U.S. Cl. ..... 362/147; 362/263; 362/265; 362/354; 362/290

(58) Field of Search ..... 362/147, 263, 362/265, 354, 290

(56) References Cited

U.S. PATENT DOCUMENTS

| | | | | |
|---|---|---|---|---|
| 4,562,517 | A | 12/1985 | Pankin | 362/241 |
| 4,626,747 | A | 12/1986 | Nilssen | 315/209 R |
| 4,631,648 | A | 12/1986 | Nilssen | 362/150 |
| 4,634,932 | A | 1/1987 | Nilssen | 315/119 |
| 4,651,059 | A | 3/1987 | Nilssen | 315/182 |
| 4,667,133 | A | 5/1987 | Nilssen | 315/312 |
| 4,998,189 | A | 3/1991 | Guggemos | 362/278 |
| 5,003,227 | A | 3/1991 | Nilssen | 315/161 |
| 5,032,765 | A | 7/1991 | Nilssen | 315/97 |
| 5,047,696 | A | 9/1991 | Nilssen | 315/312 |
| 5,132,885 | A | 7/1992 | Hocheim et al. | 362/217 |
| 5,262,700 | A | 11/1993 | Nilssen | 315/223 |
| 5,479,326 | A | 12/1995 | Nilssen | 362/148 |
| 5,559,393 | A | 9/1996 | Nilssen | 315/58 |
| 5,571,280 | A | 11/1996 | Lehrer | 362/352 |
| 5,640,069 | A | 6/1997 | Nilssen | 315/209 R |
| 5,676,457 | A | 10/1997 | Simon | 362/328 |
| 5,691,603 | A | 11/1997 | Nilssen | 315/209 R |
| 6,030,087 | A | 2/2000 | Whittle | 362/18 |
| 6,105,334 | A | 8/2000 | Monson et al. | 52/741.3 |
| 6,206,551 | B1 | 3/2001 | Stuulefield, Jr. | 362/360 |
| 6,234,643 | B1 | 5/2001 | Lichon, Jr. | 362/147 |
| 6,260,981 | B1 * | 7/2001 | Fiene | 362/147 |
| 6,435,693 | B1 * | 8/2002 | Fiene | 362/147 |
| 6,439,736 | B1 * | 8/2002 | Fiene | 362/147 |
| 6,439,741 | B1 * | 8/2002 | Diaz et al. | 362/217 |

* cited by examiner

*Primary Examiner*—Stephen Husar
*Assistant Examiner*—Anabel Ton

(57) ABSTRACT

A luminaire for ceilings, which permits improved packing density for warehousing and shipping. The reflector of the luminaire is designed to permit it to be shipped in a flattened or nested state. This increases the packing density and eliminates shipping and warehousing boxes whose volume is 95% air. An assembled luminaire comprises three or four parts: the reflector, a ballasted-socket, a lamp, and an optional diffuser or lens. The reflector, ballasted-socket, lamp, and optional lens are either shipped separately in bulk packs or shipped in kits containing the one or more sets of components to build the luminaire. When the luminaires are installed at the job site, a ballasted-socket is inserted into a mounting aperture in the reflector; a lamp is inserted into the ballasted-socket; the ballasted-socket is connected to a power source, and the assembly is placed into the ceiling opening.

102 Claims, 13 Drawing Sheets

COMPACT LUMINAIRE

REFERENCE TO RELATED APPLICATIONS

This patent is a continuation-in-part of application Ser. No. 09/507,020, filed Feb. 22, 2000 now U.S. Pat. No. 6,508,567, which is a continuation-in-part of application Ser. No. 09/471567, filed Dec. 23, 1999 now U.S. Pat. No. 6,439,736, which is a continuation-in-part of application Ser. No. 09/444182, filed Nov. 19, 1999 now U.S. Pat. No. 6,435,693; which is a continuation-in-part of application Ser. No. 09/410805 now U.S. Pat. No. 6,260,981, filed Oct. 1, 1999.

BACKGROUND

1. Field of Invention

This invention relates to luminaires in general, and compact, lightweight, field-assembled luminaires in particular.

2. Description of Prior Art

Current fluorescent luminaires are connected to the utility power line via conduit, BX, or Romex type cable. Since the fluorescent luminaire is connected directly to the utility power line via a 15 or 20-amp branch circuit, the luminaire must be designed to enclose and protect the input leads to the fluorescent lamp ballast, the lamp sockets, and the interconnecting leads between the ballast and the lamp sockets. In order to provide the necessary protection, fluorescent luminaires are made out of relatively heavy gauge steel to meet specific standards set by Underwriters' Laboratories (UL), such as, UL1570. UL requires that heavy gauge metal be used to insure that the luminaire can withstand a certain degree of abuse without exposing leads, electrical components, the ballast, current carrying parts or devices with exposed metal which could constitute a shock or fire hazard.

Due to the structural requirement set out in the UL standard, a typical 2×4 foot luminaire can weigh over 30 pounds and a 2×2 foot fixture can weigh over 15 pounds. Since current luminaires act as electrical enclosures for the fluorescent ballast and the interconnecting leads, raceway covers (also made out of heavy gauge steel) are provided to contain the potentially hazardous wiring. Luminaires, currently on the market, often contain 25 to 30 stamped metal parts plus the fasteners to hold them all together.

Because these luminaires contain such a large number of parts, they are assembled in factories, where they are packaged in individual boxes. Then they are loaded onto trucks, shipped to and stored in warehouses. They are then loaded onto different trucks and delivered to lighting wholesalers and retailers or job sites where they are stored until they are installed. In each case, the luminaires occupy a significant amount of floor space and volume.

Once at the job site the luminaires are lifted overhead into position within the ceiling grid. This is no easy task since each 2×4 luminaire can weigh 30 pounds or more. The grid system and the supporting wires are required to be sufficiently strong to accommodate this extra weight.

Fluorescent lamp ballasts currently in production are designed to operate from 15 or 20 amp branch circuits, which are typically 120, 240, or 277 volts; 60 Hertz. Due to the high energy levels available from these branch circuits, the lines connecting the input to the ballast to the branch circuit is required by the local electrical code to be run in conduit, BX, or Romex. The output leads connect the ballast to the lamp sockets and supply voltages and currents, which do not meet the limits of the National Electrical Code requirements for either Class II or Class III wiring. Therefore, this wiring too must be provided with special protective encasement by the luminaire. This is generally accomplished by designing wire raceways in the luminaire to meet special requirements established by Underwriters Laboratories.

The ballasts currently in production are either magnetic ballasts or electronic ballasts. The input power is provided from 50 or 60 Hertz line voltage and the output of the ballast is connected to a lamp socket or sockets via interconnect wiring. The magnetic ballast generally consists of a transformer with a current limited output and a power-factor correction capacitor connected across the input. Since the magnetic ballast is operating at 60 Hertz, the size of the metal can of a ballast capable of handling 60 watts of output power is 2.25" wide by 1.5" high by 8" long and weighs about 3 pounds. Electronic ballasts are generally manufactured in the same size package but weigh 1.25 to 2.5 pounds.

OBJECTS AND ADVANTAGES

Accordingly, several objects and advantages of this invention are a lighter weight, lower cost luminaire with fewer parts, requiring significantly reduced storage and shipping volume, while still maintaining an attractive appearance and providing easy assembly. This is achieved by incorporating the lamp socket into the insulated enclosure of the ballast, thus enclosing any leads or terminals that exceed class II or class III limits within the insulated ballast enclosure. This allows the luminaire to be manufactured out of lighter weight less costly material and in most cases made as a single piece with no factory assembly of the luminaire. Due to the field assembly and the unique design of the reflector portion of the luminaire, the luminaires can be nested one within another or, in another embodiment, shipped in a flattened condition. This greatly reduces the shipping and storage volume. In certain embodiments, the luminaire is capable of being assembled and installed by someone requiring no training as an electrician. For ceilings requiring a fire rating, a unique enclosure is used that provides the added weight and fire resistance characteristics necessary to meet the applicable tests and standards.

Still further objects and advantages will become apparent from a consideration of the ensuing description and accompanying drawings.

Figure 1:
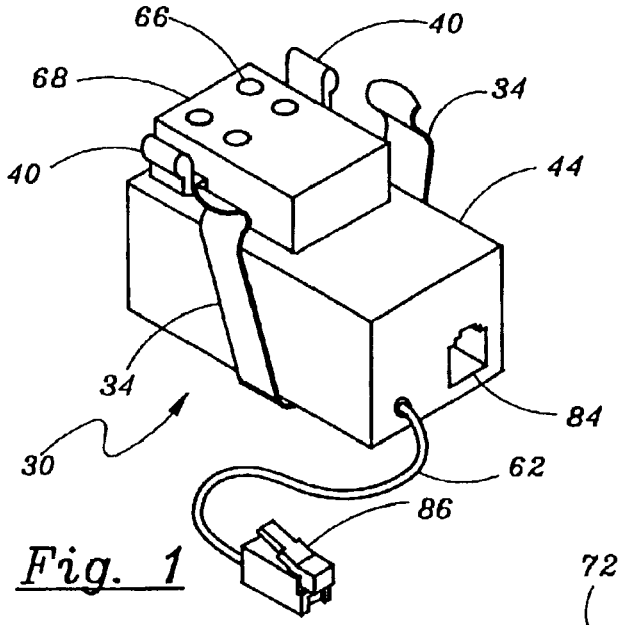
FIG. 1 shows a ballasted-socket assembly.

REFERENCE NUMERALS 1 10 2' by 2' luminaire reflector
2 12 edge A
3 14 edge B
4 16 edge C
5 18 edge D
6 20 ceiling grid opening
7 22 lip
8 24 top plane
9 26 2D lamp
10 28 aperture
11 30 ballasted-socket assembly
12 32 notches
13 34 clip
14 36 fluorescent tube
15 38 plastic support structure
16 40 lamp support clips
17 42 2' by 2' lens
18 44 enclosure
19 46 grid system
20 48 T-bars
21 50 permanent ceiling
22 52 support wires
23 54 ceiling panels
24 56 four-port energy-limited power sources
25 58 luminaire assemblies
26 60 conduit, BX, or Romex
27 62 cable assembly
28 66 output terminals
29 68 four-pin lamp socket
30 70 transformer
31 72 filament windings
32 74 ballasting capacitor
33 76 tank capacitor
34 78 tank inductor
35 80 four-pin recessed plug
36 82 depressions
37 84 power receptacle
38 86 power plug
39 88 2' by 4' reflector
40 90 2' by 4' lens
41 92 2' by 4' ceiling grid opening
42 94 compact fluorescent lamp socket
43 96 cover plate
44 98 mounting tab
45 100 shaft
46 102 ballast circuit housing
47 104 ballasted-cover-plate
48 106 compact fluorescent lamp
49 108 power cable
50 110 keyhole slots
51 112 circular aperture
52 114 sealable reflector
53 116 double-sided tape
54 118 adjacent grid opening
55 120 ballasted-socket for circular lamps
56 122 circular lamp socket -continued 1 124 steep-sided reflector
2 126 oval aperture
3 128 lamp retaining clip
4 130 lamp retaining clip slot
5 132 circular lamp
6 134 circular lamp plug
7 136 ballast clip slots
8 138 ballasted-socket for linear lamps
9 140 reflector for linear lamps
10 142 remote bi-pin lamp holder
11 144 remote bi-pin lamp holder cable
12 146 lamp support mounting holes
13 148 linear lamp
14 150 ramp
15 152 recess
16 154 relief slot
17 156 reflector for U-lamps
18 158 ballasted-socket for U-lamps
19 160 U-lamp
20 162 ballasted-socket for twin tube lamps
21 164 reflector for twin tube lamps
22 166 lamp support
23 168 twin tube lamp
24 170 aperture A
25 172 aperture pair B
26 174 aperture C
27 176 aperture D
28 178 side mounted ballasted-socket
29 for twin tube
30 180 sealable reflector for twin tube
31 lamps
32 182 lamp cradle
33 184 retaining tab
34 186 retaining slot
35 188 lamp cradle mounting holes
36 190 twin tube lamp socket
37 192 straight-in bi-pin lampholder
38 194 bi-pin lampholder
39 196 tab
40 198 side panel
41 200 continuous hinge
42 202 interlocking tab
43 204 interlocking notch
44 206 outside edge
45 208 adjoining edges
46 210 flattenable reflector
47 212 fire-rated ceiling panel
48 214 fire-rated ceiling grid
49 216 fire-rated luminaire cover
50 218 fire-rated luminaire cover
51 aperture

Summary—First Related Family of Embodiments

This invention is directed to a design of field-assembled luminaires, primarily for suspended ceilings, which permits one luminaire reflector to be nested within one or more identical luminaire reflectors to minimize shipping and warehouse space. The lamp socket is manufactured as an integral part of the ballast, and clips into and is supported by the reflector. If a lens is desired to block direct view of the lamp, it is not necessary to provide the lens as part of a hinged door. The fact that the reflector can be made from much lighter material (plastic, metal, etc.) permits the lamps to be replaced by removing an adjacent ceiling tile and sliding the reflector over the open space in the grid to access the lamp or, in the case of compact fluorescent lamps, to replace the lamp from the rear.

Description—First Related Family of Embodiments

FIG. 1 shows a pictorial drawing of a ballasted-socket assembly 30. The enclosure 44 of the ballasted-socket assembly 30 is made of electrically insulating material and encases the electronic circuitry used to provide the necessary interface between a power source and a gas discharge lamp. The back of four-pin lamp socket 68 is encased by the enclosure 44. The four-pin lamp socket 68 is provided with four output terminals 66 and with lamp support clips 40 to support the weight of a lamp when it is mounted in the four-pin lamp socket 68. Clips 34 are provided on alternate sides of the enclosure 44 to hold the ballasted-socket assembly 30 in position when mounted on a luminaire reflector. The cable assembly 62 is used to connect the ballasted-socket assembly 30 to a power source via the power plug 86. An optional power receptacle 84 can be provided as part of the ballasted-socket assembly 30. This permits another ballasted-socket to be plugged into it.

Figure 2:
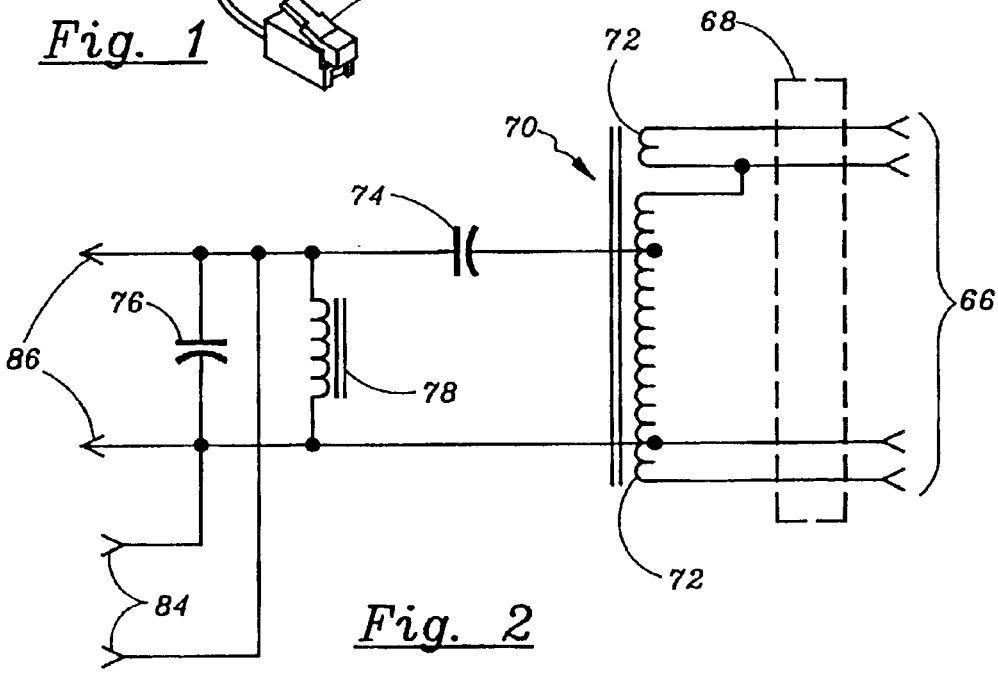
FIG. 2 shows schematically a typical ballasted-socket circuit.

FIG. 2 is a schematic of a typical ballasted-socket circuit. The power plug 86 is provided for connection to a power source. The output terminals 66 are part of the four-pin lamp socket 68 and provide voltage to heat lamp filaments and current-limited voltage to provide lamp current. Transformer 70 is used to step-up or step-down the lamp starting voltage as required by the particular lamp to be used and to supply filament voltage from the filament windings 72. Ballasting capacitor 74 limits the current supplied to the lamp after lamp ignition. Tank capacitor 76 and tank inductor 78, in concert with the reflected load and ballasting capacitor 74, form a parallel resonant tuned circuit. The optional power receptacle 84 is connected in parallel with the leads to power plug 86.

Figure 3:
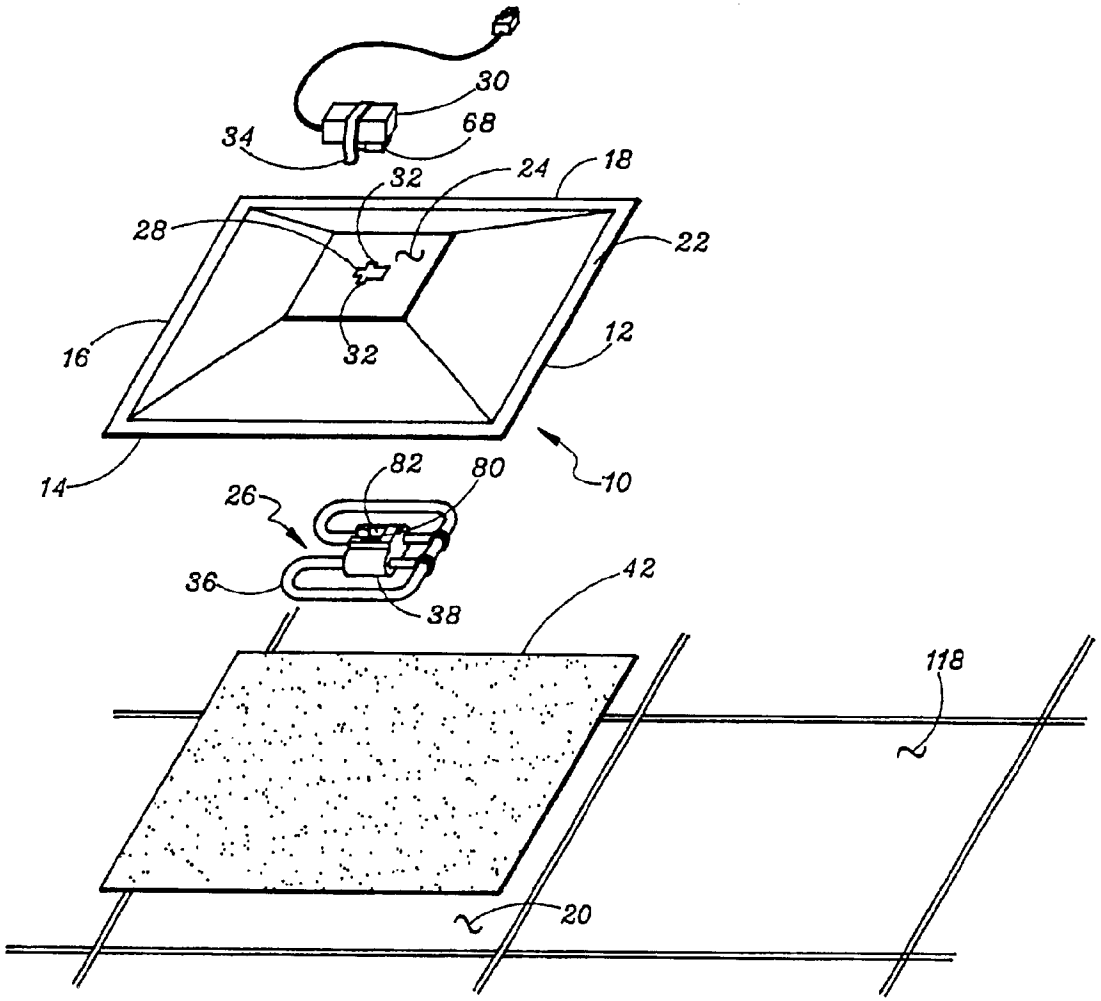
FIG. 3 is an exploded view of one embodiment of the Nestable Luminaire for single-ended lamps.

FIG. 3 is an exploded view of the instant invention showing the major components. The 2' by 2' luminaire reflector 10 in this embodiment is shown as a truncated pyramid. Edge A 12, edge B 14, edge C 16, and edge D 18 are each slightly less than two feet in length to permit the 2' by 2' luminaire reflector 10 to be placed into a 2 foot by 2 foot ceiling grid opening 20. A one-half inch lip 22 is provided around the circumference of the lower portion of the 2' by 2' luminaire reflector 10 to added rigidity to the reflector and to center the reflector within the 2-foot by 2 foot ceiling grid opening 20. The material used, in this embodiment for the 2' by 2' luminaire reflector 10, is a 0.060 inch thick, UV stabilized, white plastic with a HB flame rating. It should be noted that if the luminaire is intended to be used in a ceiling requiring a fire rating, it may be necessary to use metal in place of plastic to achieve the desired fire rating. Using plastic permits a wide variety of shapes to easily be manufactured by vacuum forming or injection molding. The top plane 24 measures approximately 12 inches by 12 inches. A typical height for the luminaire is 3 and ¾ inches. The angle of inclination of each of the sides is slightly greater than 30 degrees. The 12-inch by 12-inch dimension of the top plane 24 is determined by the lamp chosen for the luminaire. For this embodiment a General Electric F55 2D lamp 26, which is approximately 8 inches by 8 inches, is used. An aperture 28 is provided centered in the top plane of the 2' by 2' luminaire reflector 10 to receive ballasted-socket assembly 30. The aperture 28 has notches 32 on alternate sides to receive mating clips 34 located on the ballasted-socket assembly 30 to insure that the ballasted-socket assembly 30 is rigidly held in place once installed.

FIG. 3 also shows how the ballasted-socket assembly 30 is positioned relative to the 2' by 2' luminaire reflector 10. The clips 34 are to insure adequate lateral force is available to maintain the ballasted-socket assembly 30 in position when the clips 34 are inserted into the notches 32 of aperture 28.

The 2D lamp 26 shown in FIG. 3 is a General Electric 2D lamp or similar type. The 2D lamp 26 consists of a single fluorescent tube 36 that is bent to resemble two capital "Ds" back to back. The two ends of the fluorescent tube 36 each terminating at a plastic support structure 38. A four-pin recessed plug 80 is provided in the approximate center of the plastic support structure 38. The lamp also being provided with depressions 82 on alternate sides of the recessed plug 80 to receive the lamp support clips 40 shown in FIG. 1.

The optional 2' by 2' lens 42 can be a simple plastic diffuser, parabolic louver, baffle or any of the standard lens materials used with conventional luminaires. The dimension of each edge of the optional 2' by 2' lens 42 is slightly less than two feet in length to permit the optional 2' by 2' lens 42 to be placed into the 2 foot by 2 foot ceiling grid opening 20. Adjacent grid opening 118 is one of the four possible grid openings that share a common side with the grid opening containing the luminaire.

Figure 4:
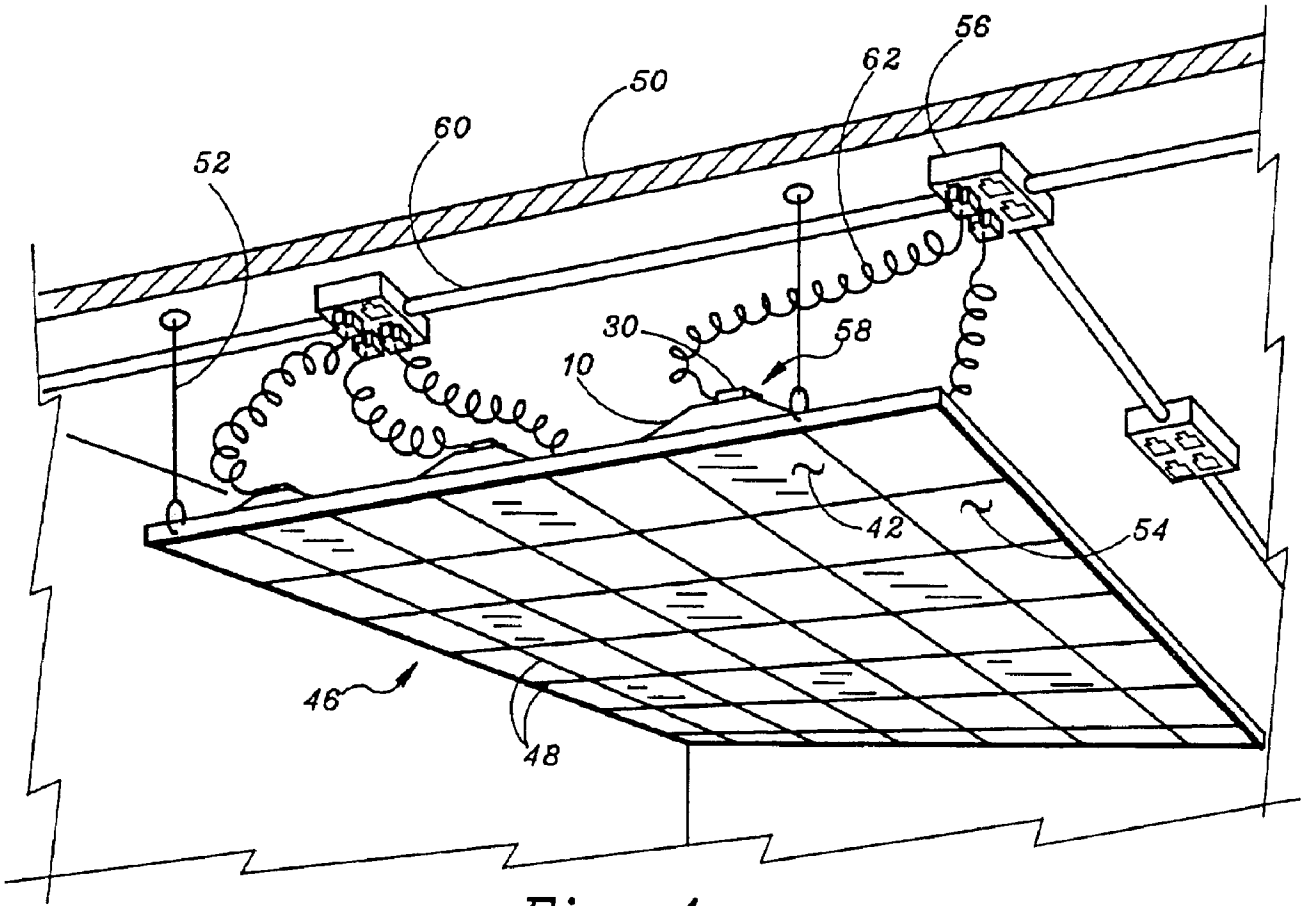
FIG. 4 shows how an overall system is installed in a suspended ceiling.

FIG. 4 shows how the overall system is installed in a suspended ceiling. A grid system 46 made up of T-bars 48 is suspended from a permanent ceiling 50 using support wires 52. The T-bars 48 are installed to provide either a 2' by 2' or a 2' by 4' grid. Luminaire assemblies 58 ar placed into the grid as required to provide the desired level of lighting. In FIG. 4, the luminaire assemblies 58 are shown in every other opening of every other row. The remaining openings are filled with ceiling panels 54. Mounted onto the permanent ceiling 50 are a series of four-port energy-limited power sources 56, one four-port energy-limited power sources 56 for every four luminaires assemblies 58. The four-port energy-limited power sources 56 are connected to the utility power line using conduit, BX, or Romex 60 as required by the local electrical code. The four-port energy-limited power source 56 is connected to the ballasted-socket assembly 30 using a lightweight cable assembly 62. The ballasted-socket assembly 30 is affixed to the top of the 2' by 2' luminaire reflector 10. An optional 2' by 2' lens 42 may be inserted in the grid system 46 ahead of the 2' by 2' luminaire reflector 10.

Figure 5:
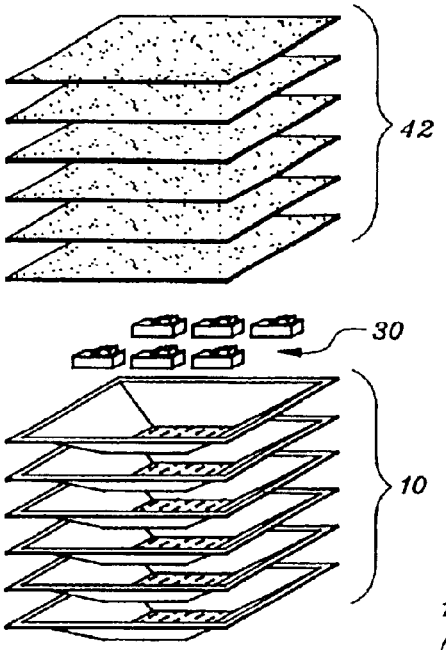
FIG. 5 shows how multiple luminaires can be nested together for shipping and storage.

FIG. 5 is an exploded view showing how multiple luminaires can be nested together for shipping and storage. This figure shows six reflectors 10 nested one within another. Six ballasted-sockets 30 can be placed within the center cavity of the top reflector. Six 2' by 2' lenses 42 are then stacked on top of the top reflector 10.

Figure 6:
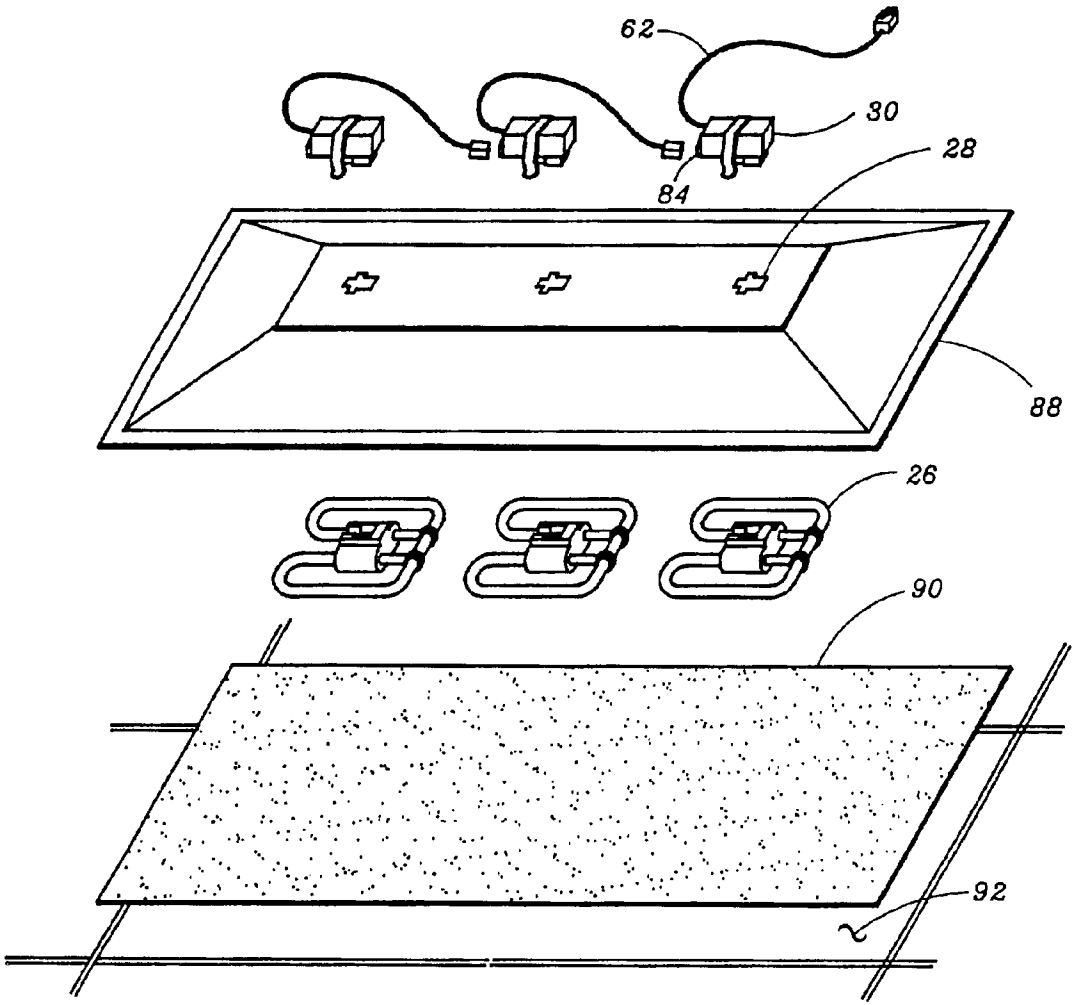
FIG. 6 shows how the same invention can be applied to 2' by 4' luminaires.

FIG. 6 shows an exploded view of a 2' by 4' luminaire. The 2' by 4' reflector 88 contains three apertures 28 to receive three ballasted-socket assemblies 30 each of which is provided with cable assembly 62 and power receptacle 84. Three 2D lamps 26 are inserted into the ballasted-sockets from the bottom side of the 2' by 4' reflector 88. The 2' by 4' lens 90 is shown located above 2' by 4' grid opening 92.

Figure 7:
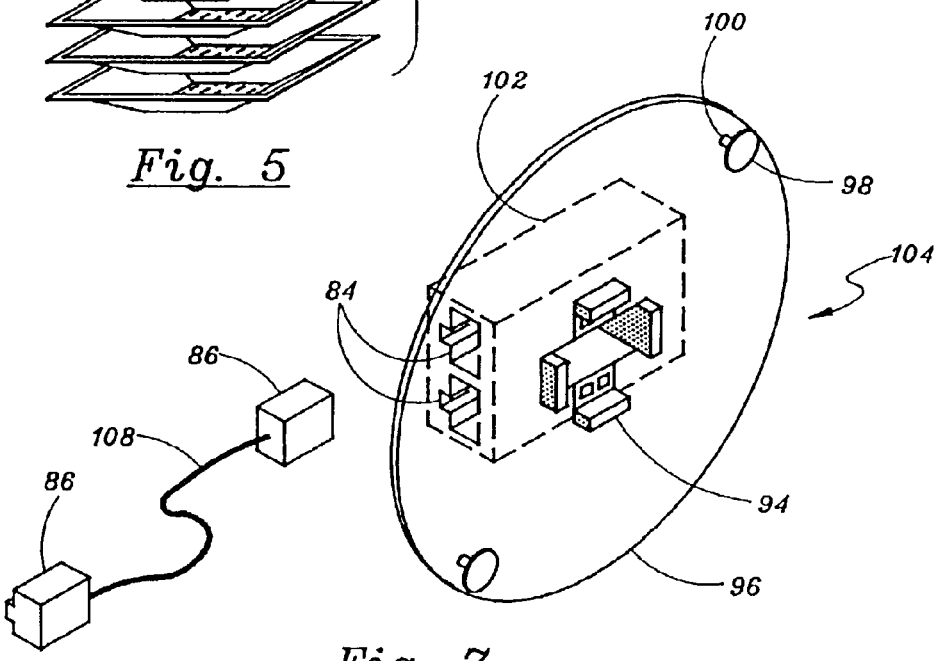
FIG. 7 shows a variation of the ballasted-socket, which allows lamps to be replaced from the rear of the luminaire.

FIG. 7 shows a ballasted-cover-plate 104 for compact fluorescent lamps. Compact fluorescent lamp socket 94 projects through the center of the cover plate 96. Mounting tabs 98 are round discs approximately 0.3 inches in diameter located in a plane parallel to the cover plate 96 and 0.060 inches above it. The mounting tabs are held in place by a shaft 100, which is affixed into the cover plate 96. The ballast circuit housing 102 encloses all circuitry, the back of compact fluorescent lamp socket 94 and two power receptacles 84. Also shown is power cable 108 with power plug 86 attached to each end.

Figure 8:
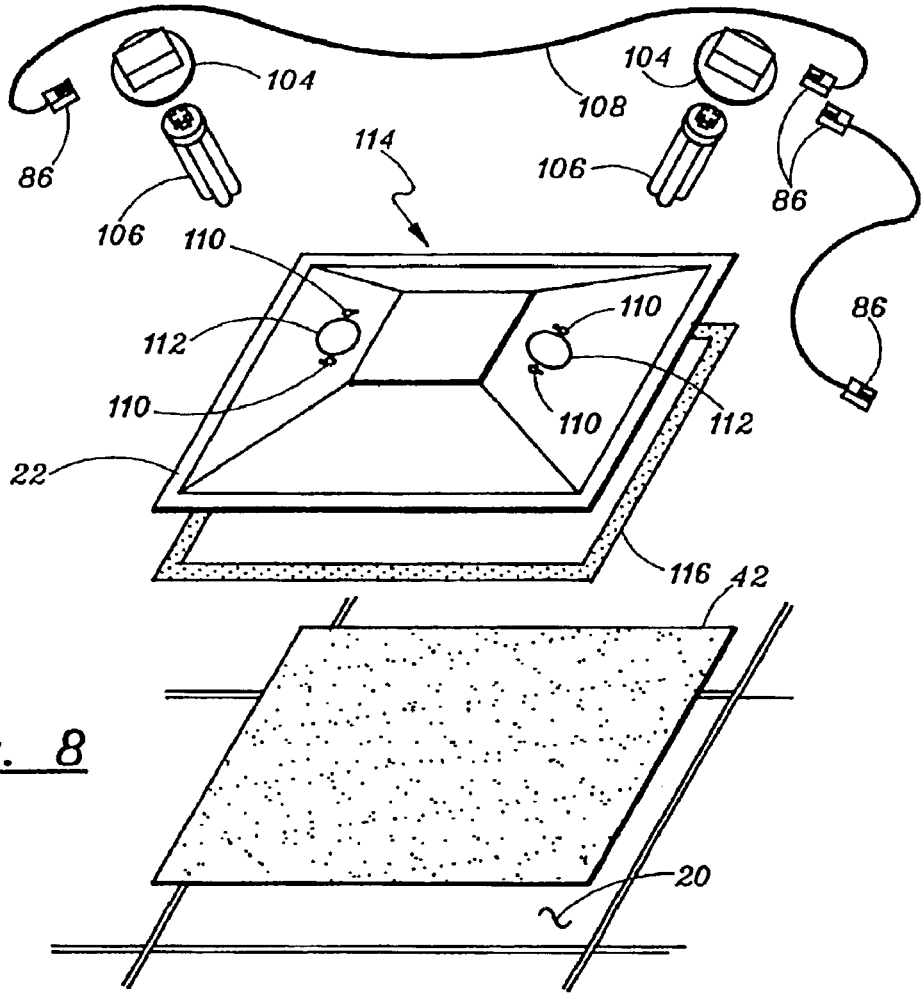
FIG. 8 shows how the invention can be applied to luminaires using one or more compact fluorescent lamps.

FIG. 8 shows how the invention can be applied to luminaires, which use one or more compact fluorescent lamps. The sealable reflector 114 is provided with one or more circular apertures 112 with keyhole slots 110 on opposite sides of the aperture. The ballasted-cover-plate 104 is provided with a socket to receive compact fluorescent lamp 106. The ballasted-cover-plate is also provided with two power receptacles, either of which can receive power cable 108. Power cable 108 is provided with power plugs 86 at each end. An optional strip of double-sided tape 116 can be supplied with the sealable reflector 114. Beneath the sealable reflector is lens 42 that is positioned above a 2' by 2' ceiling grid opening 20.

Operation—First Related Family of Eembodiments

Referring to FIG. 1, the ballasted-socket 30 encapsulates the ballast circuitry, all wiring, plus the connections between the ballast circuitry and the four-pin lamp socket 68; therefore, the ballasted-socket 30 is the only part of the luminaire which must meet the stringent requirements regarding the enclosure of fluorescent lighting fixtures established by Underwriters' Laboratories, Inc. in UL1570. Input power is provided to the ballasted-socket assembly 30 through power plug 86 and cable assembly 62. An alternative connection technique, not shown, is to use insulation displacement connectors built into the ballasted-socket assembly 30 into which a multi-conductor cable is inserted and a cover or cam is slid or rotated into place to make the connection via contact point which pierce the insulation, similar to the plugs that are added to lamp cords.

FIG. 2 is typical of a circuit, which can be used in a ballasted-socket assembly or ballasted-cover-plate. In a preferred embodiment, the circuit is powered from a class II or class III power-limited supply. As a result, the National Electrical Code does not require the interconnecting wires between the power supply and the ballasted-socket assembly to be run in conduit or BX, but permits much lighter weight non-armored cable to be used. In order to minimize the physical size of the electronic components used for the ballast circuitry (tank capacitor 76, tank inductor 78, ballasting capacitor 74, and transformer 70) an operating frequency in the range of 18 kHz to 100 kHz is preferred. The filament windings 72 provide voltage to heat the lamp filaments for rapid start operation. By increasing the secondary turns and eliminating the filament windings, instant start operation can be achieved.

Referring to FIG. 3, a complete luminaire consists of a ballasted-socket assembly 30, a lamp 26, an optional lens 42 and the 2' by 2' luminaire reflector 10. The reflector merely supports the ballasted-socket assembly 30 and reflects the light down to the room being illuminated, but does not enclose any wires, transformers, capacitors, ballasts, current-carrying parts, devices with exposed metal, leads or terminals for field connection of supply wires. Therefore, the enclosure requirements of UL1570 do not have to be met by the reflector portion of the luminaire. This means that the reflector can be manufactured out of much lighter gauge material than that required for the equivalent conventional luminaire. The luminaires can be shipped to the job site in bulk (i.e. the 2' by 2' luminaire reflectors 10 can packed by nesting one reflector within another). As a result, the equivalent of ten conventional 2' by 2' troffer type luminaires can be placed in on container measuring 2' by 2' by 6" thick and weigh a total of only 25 pounds including the reflectors, ballasted-sockets, and lenses. Ten conventional 2' by 2' troffers would normally be packed in individual boxes measuring 2' by 2' by 5" thick and create a stack over four feet tall weighing 150 pounds. It would take sixty nestable luminaires to add up to 150 pounds and they would only stand 12 inches tall. Each additional reflector increases the height of the stack by only slightly more than the material thickness of the reflector.

Since the luminaire reflector 10 can be made out of a single sheet of material, this piece can be inexpensively manufactured by being vacuum formed or injection molded in the case of plastic, or either drawn or fabricated out of a single sheet of steel or aluminum. In situations where the luminaire is installed without a diffuser for a lens, it is possible to provide a textured finish on the reflecting side of the reflector to greatly reduce the amount of glare that would otherwise be produced by the glossy painted surface of a conventional luminaire.

In its basic form, the nestable luminaire can be manufactured with a single piece reflector. This is the only part requiring significant tooling. It does not require the tooling of numerous channels, covers and clips that is required for the equivalent conventional luminaire. Thus, the tooling cost to get into the luminaire business using the nestable luminaire approach is dramatically less than the cost to get into the business of manufacturing conventional luminaire designs. Again, due to the fact that the physical volume required to ship a finished reflector is no more and in some cases actually less than the volume to ship the raw material, the luminaire reflector can be manufactured anywhere in the world and shipped to the job site for 2% of what it would cost to ship conventional luminaires. Therefore, the suppliers of the luminaire reflectors are not limited to domestic vendors. There is no factory wiring; therefore, there is no manufacturing space or labor required for wiring the nestable luminaire.

As seen in FIG. 3 the entire luminaire can be assembled from three components, the luminaire reflector 10, the ballasted-socket assembly 30 and a lamp 26. An optional lens 42 can be added to reduce glare. As stated previously, one key feature of the nestable luminaire is its dramatic reduction in shipping and warehousing volume. In order to achieve the maximum reduction in volume the luminaire is shipped disassembled. It is therefore necessary that the luminaire is capable of being easily assembled at the job site. As shown in FIG. 3 the ballasted-socket 30 is merely clipped into the luminaire reflector 10 using the clip 34. The lamp 26 is then inserted into the four-pin lamp socket 68 of the ballasted-socket assembly 30. If a lens is used, the lens 42 is placed into the ceiling grid opening 20. The reflector 10, which also has the lamp 36 and ballasted-socket 30 installed, is placed over the lens 42 into the ceiling grid opening 20 from an adjacent grid opening 118. This installation process becomes a much easier task since the weight of a 2' by 2' luminaire is less than 3 pounds instead of 15 and in the case of a 2' by luminaire the weight is less than 6 pounds instead of nearly 30. It should be noted that a significant portion of the shipping advantage of the nestable luminaire could still be achieved with ballasted-socket installed before shipping.

Referring to FIG. 4, once the luminaire has been placed into the suspended ceiling grid system 46 the cable assembly 62 is plugged into a four-port energy-limited power source 56 (for an example of an acceptable energy-limited power source see U.S. Pat. No. 5,691,603). Since in the case of an energy-limited system the wiring between the power source and the luminaire is class II or class III, it is only necessary to have an electrician install the four-port energy-limited power sources 56. The wiring between the power source and the luminaire can be installed by unskilled labor, because the wiring merely plugs together. Even where unions may require the luminaires to be installed by electricians, the speed at which the luminaires are installed will be very much increased and installation cost very much reduced.

FIG. 5 shows how the reflectors 10 can be nested one within another and one possible way of packaging the luminaires as do-it-yourself (DIY) kits. In this case, six reflectors 10 are packed with six ballasted-sockets 30 packed in the center of the top reflector. The lenses 42 are then packed on top of the upper reflector. This kit of six luminaires will fit in roughly the same size container that is currently used for a single equivalent conventional luminaire. Another alternative for both the DIY market and the commercial market is to ship the reflectors 10, ballasted-sockets 30, lenses 42 and lamps 26 separately in bulk, perhaps 50 to 100 per container. This way the do-it-yourselfer or commercial user can mix and match reflectors, ballasted-sockets, lenses and lamps. Also, if the aperture 28 of the reflector 10 (see FIG. 3) and the mounting technique of the ballasted-socket 30 were standardized, then the end user can choose a ballasted-socket from one of a number of ballast manufacturers on a reflector assembly from one of several luminaire manufacturers. The shelf space savings generated by the reduced volume of the nestable luminaire is especially important to the lighting retailer and home improvement center, where the shelf space is particularly valuable, since the merchandise is often warehoused on the store shelves.

FIG. 6 shows how the same invention can be applied to a 2' by 4' luminaire. The 2' by 4' reflector 88 contains one or more apertures 28. The ballasted-sockets 30 are clipped into the 2' by 4' reflector 88. The lamps 26 are inserted into the ballasted-sockets 30. The luminaires are then installed into the ceiling grid as previously discussed. To minimize the wiring above the suspended ceiling, each ballasted-socket 30 can be provided with a power receptacle 84 allowing one ballasted-socket 30 to be plugged into the preceding one with only one cord assembly 62 run back to the power source. All comments regarding the nesting, shipping, and warehousing previously discussed also apply to this type of luminaire.

The ballasted-cover-plate 104 in FIG. 7 is similar to the ballasted-socket assembly 30 except the ballast circuitry is mounted on a cover plate 96. A compact fluorescent lamp socket 94 is mounted on the cover plate 94 also. In the configuration shown, access to the compact fluorescent lamp socket 94 is through the cover plate. In other configurations, the lamp socket 94 may be mounted on the cover plate 96 without requiring that the base of a lamp extend through the cover plate 96. The diameter of the cover plate 96 is made slightly larger than the base of a compact fluorescent lamp. As an alternative to having a cable assembly as part of the ballasted-socket, the ballasted-cover-plate 104 is shown with two parallel-connected power receptacles 84. A separate power cable assembly 108 is provided with power plugs 86 at each end to interconnect the ballasted-cover-plate 104 to a power source.

Using a ballasted-cover-plate 104 permits relamping from the rear of the fixture as is shown in FIG. 8. A compact fluorescent lamp 106 is inserted into the compact fluorescent lamp socket of the ballasted-cover-plate 104. The compact fluorescent lamp is inserted through the circular aperture 112. The two mounting tabs 98 (shown in FIG. 7) are placed through the large ends of the two keyhole slots 110 located on both sides of circular aperture 112. The ballasted-cover-plate 104 is then rotated to lock it in place. If more than one lamp is used, the same procedure is followed for the remaining lamps. If a diffuser is used for the lens 42, the luminaire can be sealed by removing the paper backing from one side of the double-sided tape 116 and attach it to the bottom side of lip 22 around the perimeter of the luminaire. The lens 42 is then placed into the ceiling grid opening 20. The backing is removed from the double-sided tape 116. The sealable reflector 114 is then inserted through an adjacent grid opening and placed over the lens 42. Once in place, the double-sided tape adheres to the lens 42 and forms a sealed unit minimizing the infiltration of dirt. When a lamp reaches its end of life, the ballasted-cover-plate 104 is removed from the rear of the sealable reflector 114, the lamp is replaced with a new one and the ballasted-cover-plate 104 is reinstalled. It may be more cost effective in some cases to have the double-sided tape 116 preinstalled on the lens or the reflector by the manufacturer.

It should be noted that the sides of the reflector can be designed to be much steeper. As the sides of the reflector get steeper the improvement in packing density is somewhat decreased and is a function of the angle of the sides plus the thickness of the material used to manufacture the reflector, but significant improvement in the packing density compared to individually boxed luminaires is still achieved. For instance, if the reflector is designed such that a second reflector nested over it creates a gap of 1 inch between the top planes 24 of the two reflectors, and the height of each reflector is approximately 4 inches, then when ten reflectors are shipped nested, they will still only occupy roughly one-third of the volume of individually boxed conventional luminaires. With a design that creates a gap between top planes, the option exists to supply the ballasted-socket assemblies preinstalled either on the backside as has been shown, or with minor modifications to the mounting arrangements and power input connection it can be preinstalled on the inside of the reflector.

Summary—Second Related Family of Embodiments

The First Related Family of Embodiments demonstrates how the nestable luminaire is used with 2D lamps and compact fluorescent lamps. The second related family of embodiments applies the same concept to circular lamps, linear lamps, U-lamps and long-twin-tube type lamps. To accommodate these lamps, the sides of the reflector of the luminaire are made steeper to make the larger top plane required by these lamps. The concept is still the same in that the luminaire is comprised of the same three or four basic parts: a ballasted-socket, a reflector, a lamp or lamps, and an optional lens. The reflectors are capable of being nested one within another to minimize shipping volume. The ballasted-sockets can be shipped either packaged within the top reflector or shipped separately in bulk. The luminaires are then easily assembled at the time of installation.

Description—Second Related Family of Embodiments

Figure 9:
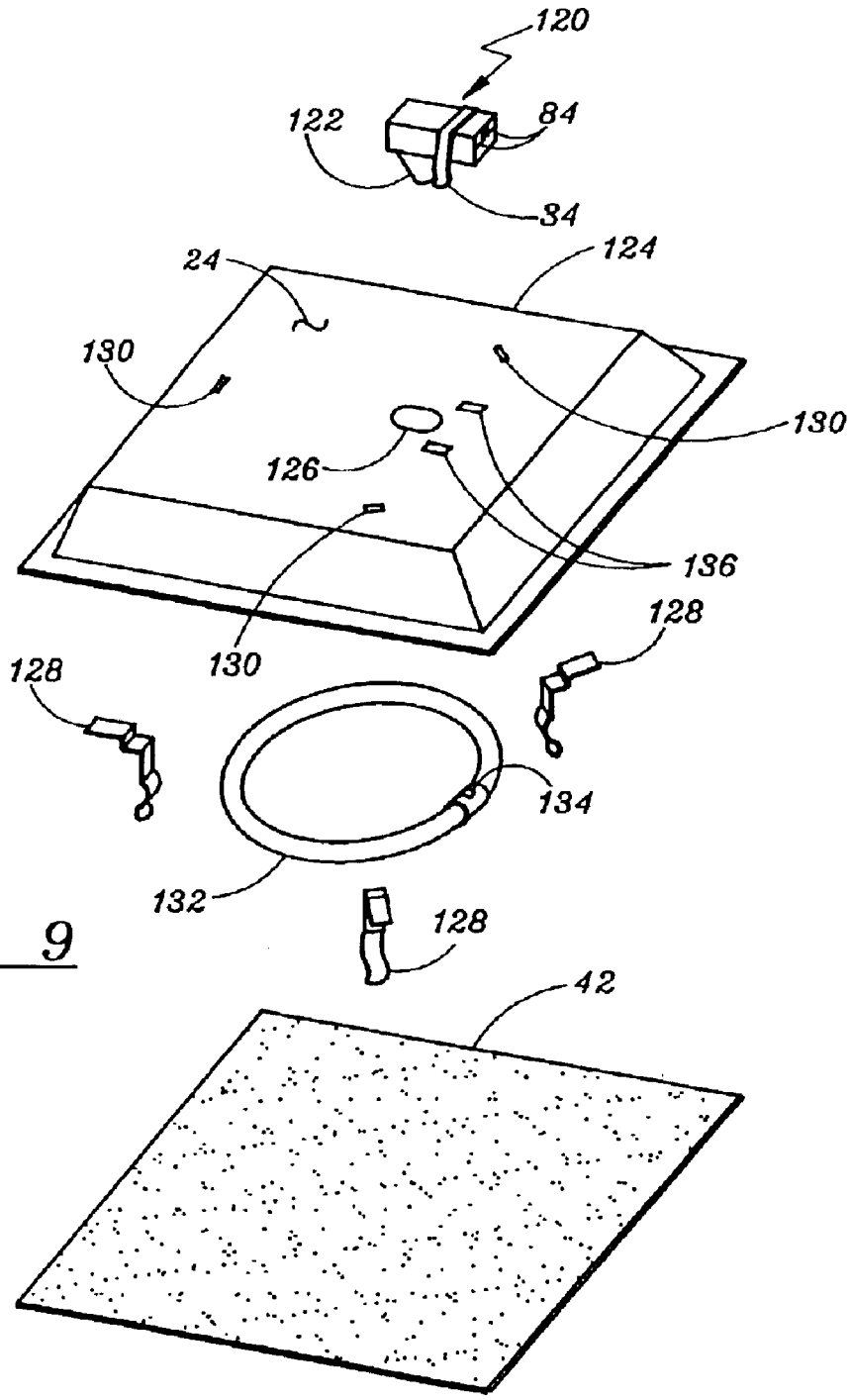
FIG. 9 shows how a circular lamp can be used with a ballasted-socket in a nestable luminaire.

FIG. 9 is an exploded view of a nestable luminaire for a circular lamp. Steep-sided reflector 124 contains three sets of apertures and slots in its top plane 24. Oval aperture 126 is designed to receive circular lamp socket 122 of ballasted-socket for circular lamps 120. Ballast clip slot 136 is for engagement of clip 34. The ballasted-socket for circular lamps 120 includes two power receptacles 84. Lamp retaining clip slots 130 are designed to receive lamp retaining clip 128. Circular lamp 132 is provided with circular lamp plug 134. An optional 2' by 2' lens 42 may be a diffuser or parabolic lens.

Figure 10:
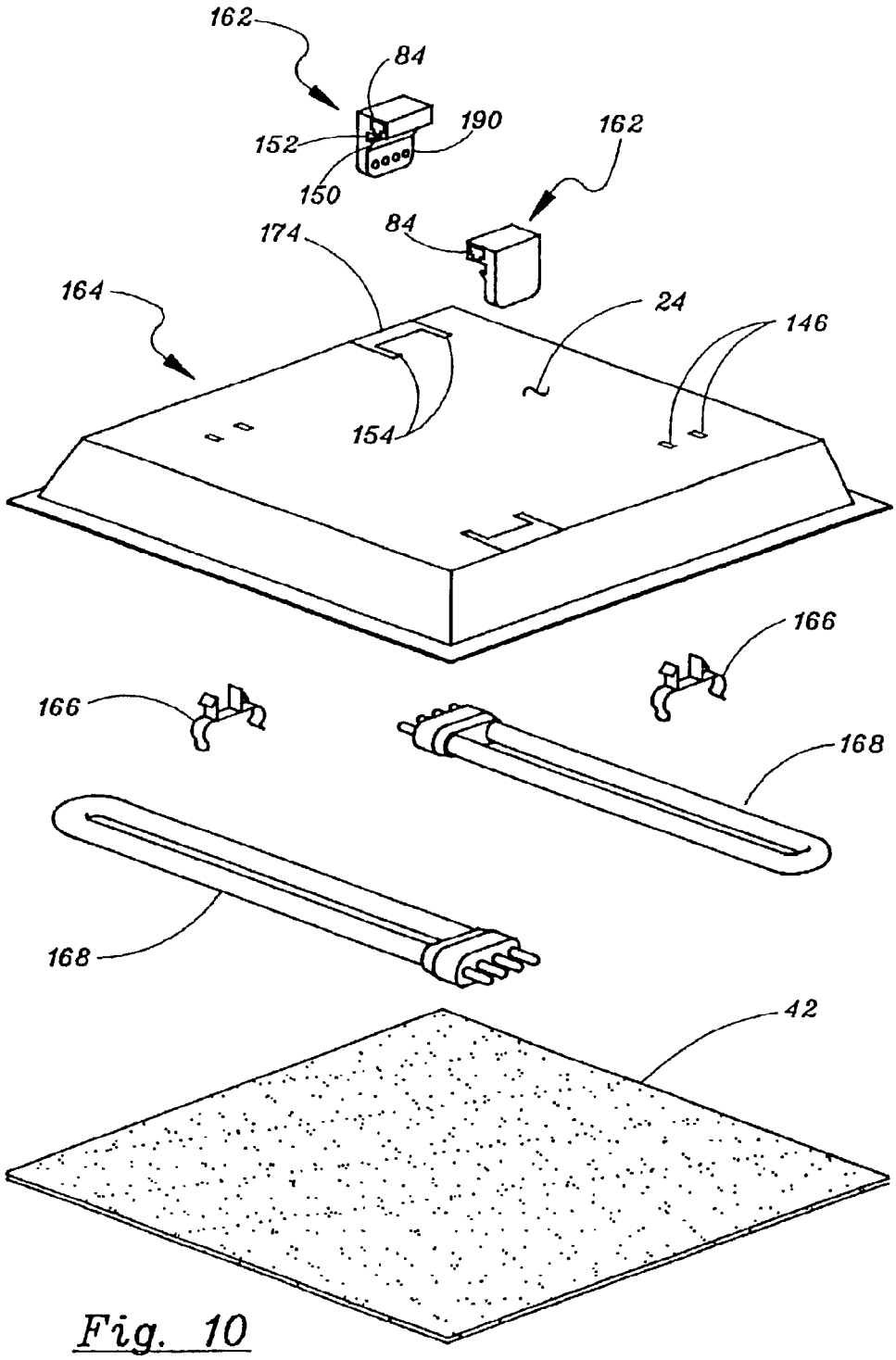
FIG. 10 shows how linear lamps can be used with a ballasted-socket in a nestable luminaire.

FIG. 10 is an exploded view of a nestable luminaire for long-twin-tube lamps. The top plane 24 of reflector for twin tube lamps 164 contains lamp support mounting holes 146 and aperture C 174 with relief slots 154 on alternate sides. Ballasted-socket for twin tube lamps 162 is provided with ramp 150 and recess 152 plus a power receptacle 84 on each end and twin tube lamp socket 190. Lamp support 166 is spring loaded to clamp around the parallel tubes of the twin tube lamp 168. The optional lens 42 can be a diffuser or a parabolic lens.

Figure 11:
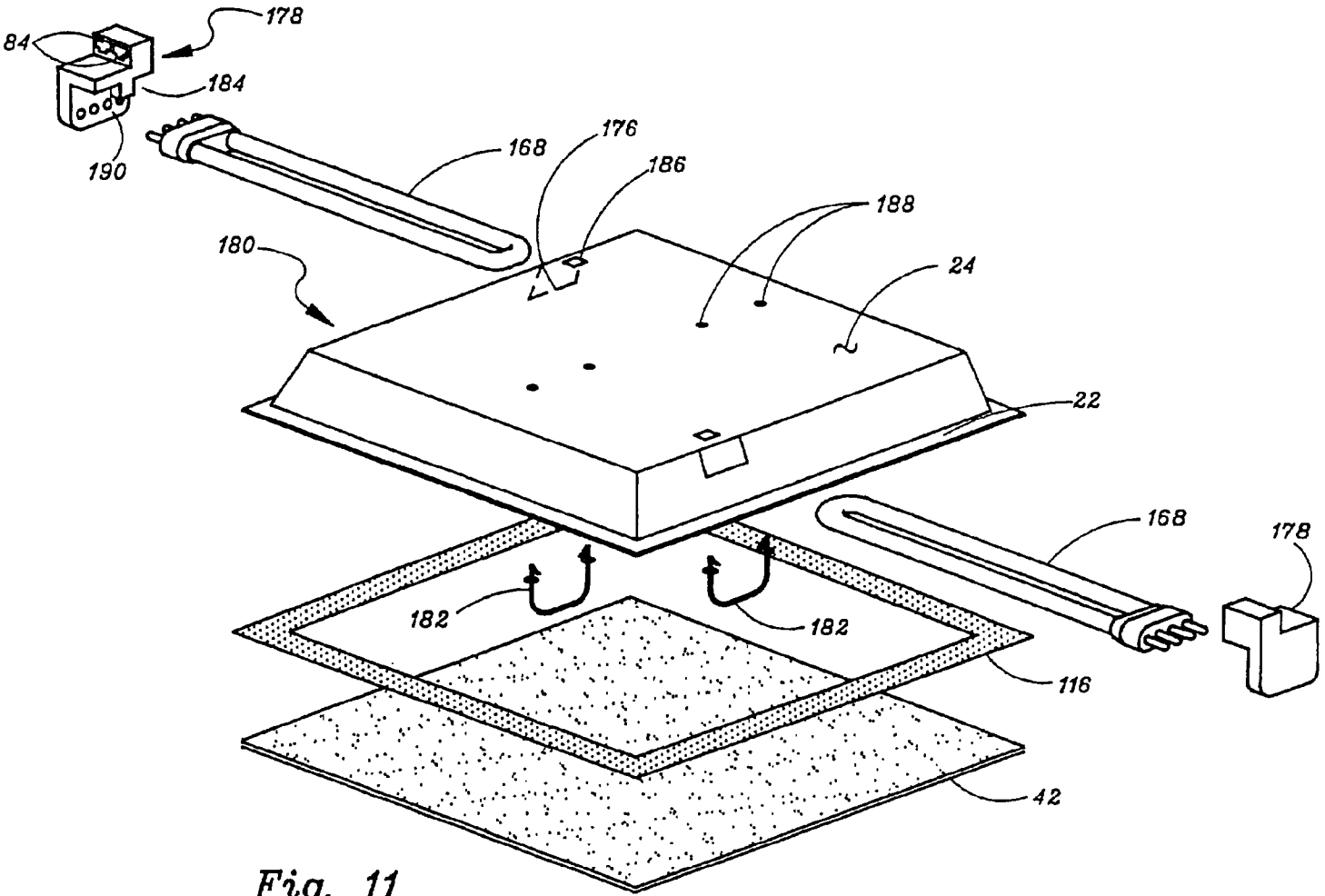
FIG. 11 shows how U-lamps can be used with a ballasted-socket in a nestable luminaire.

FIG. 11 is an exploded view of a nestable luminaire for long-twin-tube lamps used as a sealable luminaire. The top plane 24 of sealable reflector for twin tube lamps 180 contains the lamp cradle mounting holes 188 and retaining slot 186. The side of the sealable reflector for twin tube lamps 180 contains the aperture D 176, which receives side-mounted ballasted-socket for twin tube lamps 178. The side-mounted ballasted-socket for twin tube lamps 178 has two power receptacles 84 a twin tube lamp socket 190 and a retaining tab 184. Lamp cradle 182 is a narrow plastic or metal U-shaped bracket designed to be inserted into and held by lamp cradle mounting holes 188. The lamp cradle 188 supports the twin tube lamp 168 in a plane parallel to the top plane 24. Double-sided tape 116 is used to adhesively seal lens 42 to lip 22.

Figure 12:
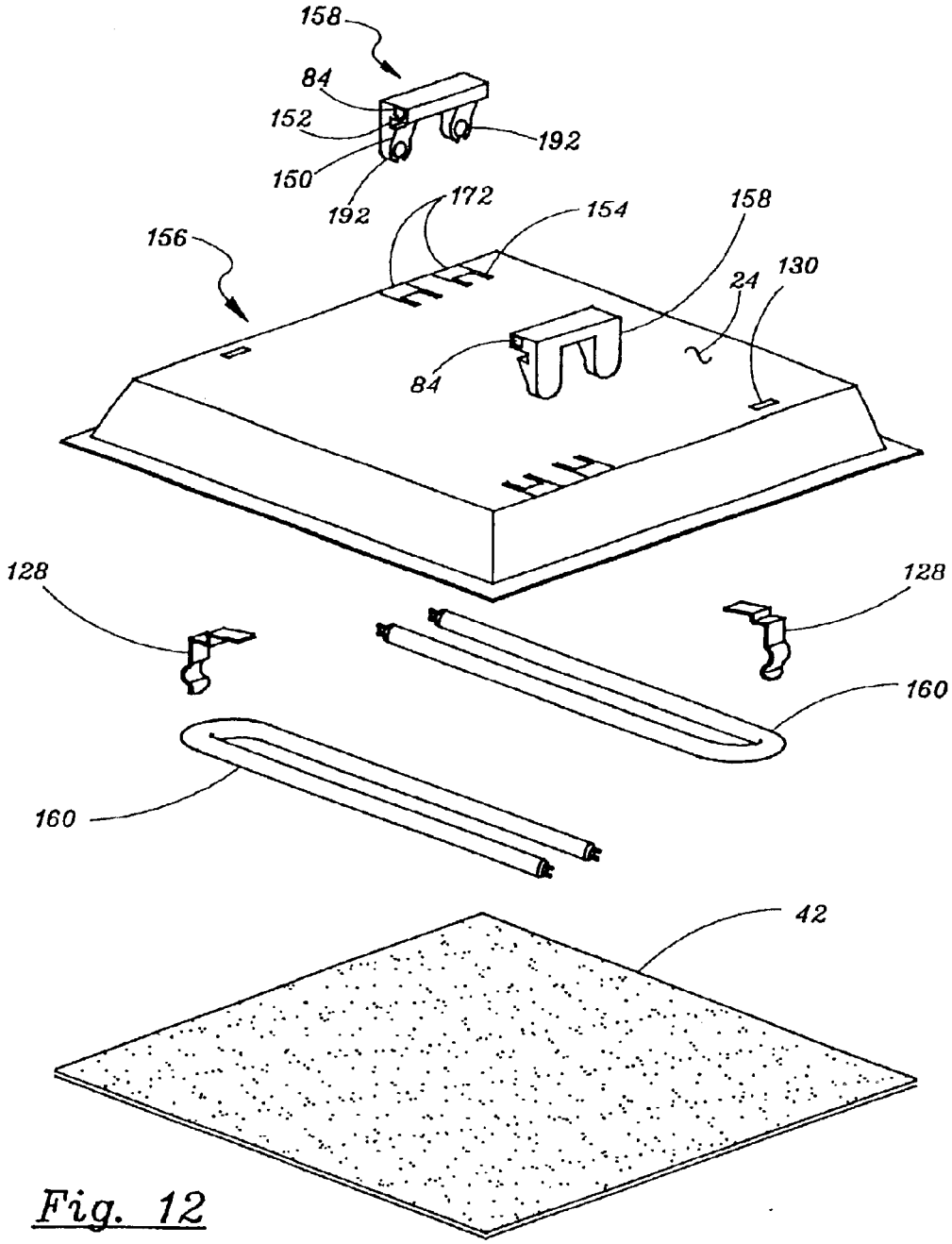
FIG. 12 shows how long-twin-tube lamps can be used with a ballasted-socket in a nestable luminaire.

FIG. 12 is an exploded view of a nestable luminaire for U-lamps. The reflector for U-lamps 156 contains aperture pair B 172 to receive ballasted-socket for U-lamps 158. Each aperture pair 172 having relief slots 154 on each side of each aperture. The ballasted-socket for U-lamps 158 has a power receptacle 84 at each end as well as a straight-in bi-pin lampholder 192 at each end. The two straight-in bi-pin lampholders 192 facing the same direction with the opening capable of receiving the lamp bi-pins located 90 degrees to the axis of the longest dimension of the ballasted-socket for U-lamps 158. A typical center-to-center distance between the two lamp holders is six inches. Each of the straight-in bi-pin lampholders 192 has a ramp 150 and recess 152. The top plane 24 also contains lamp retaining clip slot 130 for the insertion of lamp retaining clip 128. A typical U-lamp 160 is a 1-inch diameter lamp bent in the shape of a U with a center-to-center leg spacing of six inches and nominal length of 22 inches. Optional lens 42 can be either a diffuser or a parabolic lens.

Figure 13:
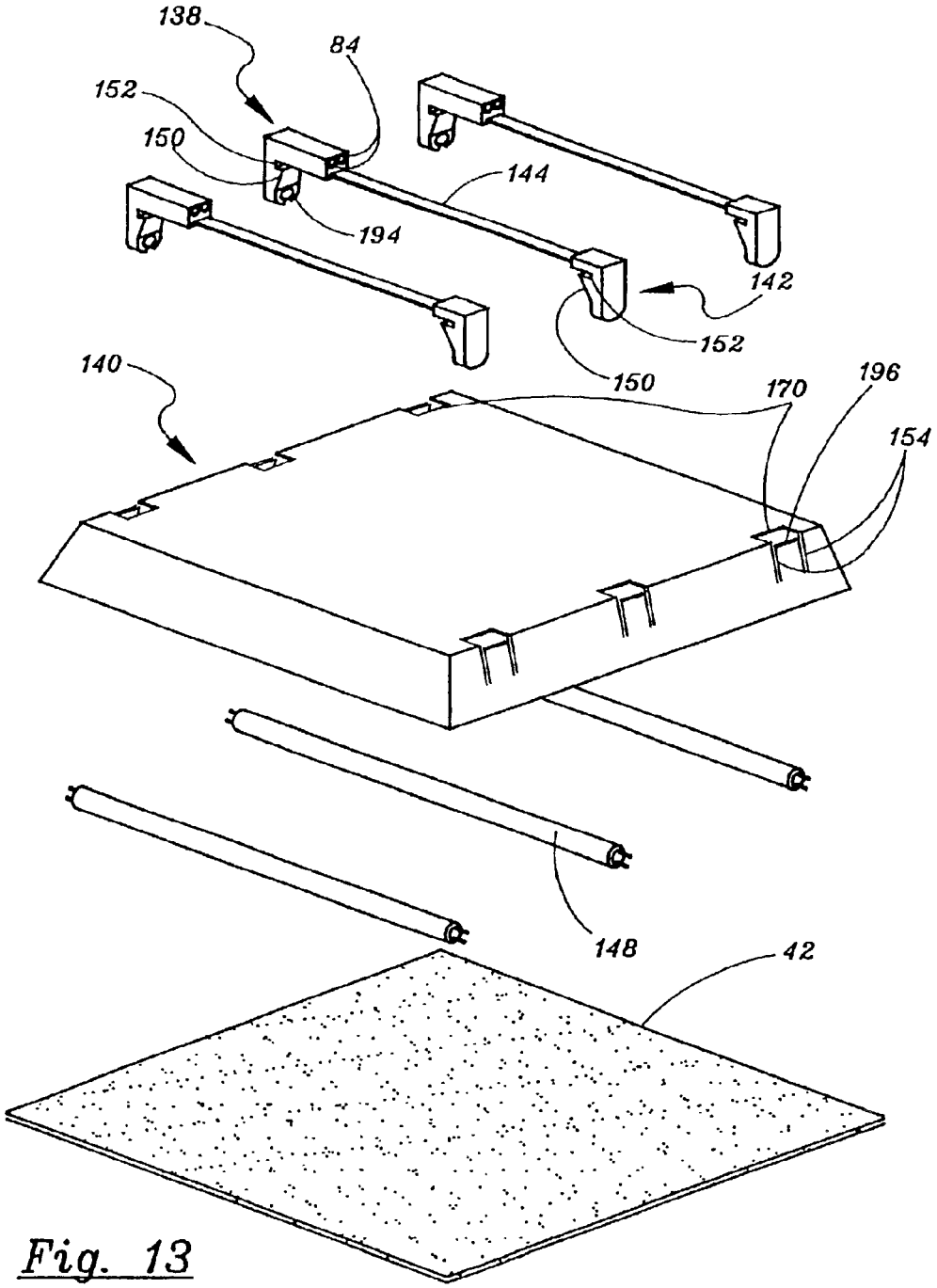
FIG. 13 shows how long-twin-tube lamps can be used with a ballasted-socket in a sealable-nestable luminaire.

FIG. 13 is an exploded view of a nestable luminaire for linear lamps. Reflector for linear lamps 140 contains at least one pair of apertures A 170 to receive the main body of ballasted-socket for linear lamps 138 and remote lamp socket 142. The main body of ballasted-socket for linear lamps 138 contains one or more power receptacles 84. Tab 196 allows the width of the aperture to increase to permit insertion of a lampholder. The main body of the ballasted-socket for linear lamps 138 and the remote lamp socket 142 are provided with a ramp 150 and a recess 152. The main body of the ballasted-socket for linear lamps is connected to the remote bi-pin lampholder 142 by remote bi-pin lampholder cable 144. This cable can be a single conductor for instant start lamps, a pair of insulated conductors or a pair of insulated conductors within a cable for rapid start lamps. For rapid start lamps, when the ballasted-socket is powered from a Class II or Class III circuit, the conductors in the remote bi-pin lampholder cable 144 become a Class II circuit since the voltage between the conductors is nominally only 3.6 volts and if the input to the ballasted-socket is power limited, the output between these conductors is also power limited to the same power level. Therefore, no special enclosure requirements apply regarding UL 1570. If the ballasted-socket for linear lamps is powering rapid start lamps and is powered from a non-Class II or III circuit, the remote lamp socket cable 144 needs to be enclosed appropriately to meet the requirements of UL1570 or a circuit component, such as, a capacitor must be added within the ballasted-socket enclosure in series with one of the conductors to limit the current available between the two conductors to a level that is within the Class II limits. The length of the remote bi-pin lampholder cable 144 is determined by the length of the linear lamps used in the luminaire. In some cases, it may be desirable to enclose this cable in a rigid housing to mechanically connect the main body of the ballasted-socket for linear lamps 138 to the remote bi-pin lampholder 142. Linear lamps 148 are shown above lens 42.

The reflector for linear lamps is shown without a lip around the perimeter of the luminaire. For T5 rapid start lamps the reflector can be made with or without a lip since a nominal 2 foot lamp has an overall length of 21.6 inches and a nominal 4 foot lamp has an overall length of 45.2 inches. T8 and T12 lamps are only 0.25 inches shorter than their nominal length. Therefore, there is no room to add the lip to these reflectors. In addition, the lampholders are held in by tab 196. This tab allows the lampholders to be spaced sufficiently to accept T8 and T12 lamps.

Refer to FIG. 2 for a circuit that is typical of a circuit that might be used in the various ballasted-sockets shown in FIG. 9 through FIG. 13.

Operation—Second Related Family of Embodiments

FIG. 9 shows how a nestable figure is adapted to use circular lamps. The ballasted-socket for circular lamps 120 has an integral circular lamp socket 122 mounted at approximately 45 degrees from vertical and toward the center of the ballasted-socket. All the ballast circuitry is contained within the housing of the ballasted-socket; therefore, the ballasted-socket is the only part of the luminaire that needs to meet the structural and electrical requirements of UL1570. At the time of installation, the ballasted-socket for circular lamps 120 is attached to the steep-sided reflector 124 by inserting circular lamp socket 122 through oval aperture 126 and engaging clip 34 into ballast clip slot 136. The lamp retaining clips 128 are each inserted into lamp retaining clip slots 130. The circular lamp 132 is then forced over the lamp retaining clips 128 with the circular lamp plug 134 engaging the circular lamp socket 122. This assembly is then inserted into a ceiling grid opening preceded by an optional lens 42. The power receptacle 84 is then connected to a source of power.

The embodiment shown in FIG. 9 shows a single lamp, but the same approach can be applied to two or even three concentric circular lamps of different diameters by either providing two or three separate ballasted-sockets at various angles from one another or by using a single ballasted-socket with appropriate circuitry plus two or three integral sockets spaced appropriately along the length of the ballasted-socket assembly.

FIG. 10 shows how a nestable luminaire is adapted to use long-twin-tube type lamps. The ballasted-socket for twin tube lamps 162 has an integral twin tube lamp socket 190 and two power receptacles 84 one on each end. The integral twin tube lamp socket 190 is provided with a ramp 150 and a recess 152. At the time of installation, the ballasted-socket for twin tube lamps 162 is inserted into aperture C 174. Aperture C is provided with relief slots 154 on each end of the aperture to permit the material used for the reflector to flex enough to permit the end of the ramp 150 to pass over it and lock this tab into recess 152, thus capturing the ballasted-socket for twin tube lamps 162 within aperture C 174. Lamp support 166 is inserted into lamp support mounting holes 146 from underneath. Twin tube lamp 168 is then inserted into twin-tube lamp socket 190 and pressed into lamp support 166. This assembly is placed into a ceiling grid preceded by optional lens 42. The power receptacle 84 is then connected to a source of power.

FIG. 11 shows how a nestable luminaire is adapted to use long-twin-tube type lamps in a sealable nestable luminaire. The side-mounted ballasted-socket for twin tube lamps 178 has an integral twin tube lamp socket 190 and two power receptacles 84. In this embodiment, the lamp cradle 182 is insert into lamp cradle mounting holes 188 from the bottom side of the sealable reflector for twin tube lamps 180. The twin tube lamp 168 is inserted into the twin-tube lamp socket 190 of the side-mounted ballasted-socket for twin tube lamps 178. This assembly is then inserted through aperture D 176, allowing the twin-tube lamp 168 to rest on and be guided by lamp cradle 182. The retaining tab 184 is placed in retaining slot 186. This locks the ballasted-socket in place. The lens 42 is placed into a ceiling grid opening. The backing from one side of the double-sided tape 116 is removed and placed into the grid with the exposed side against the lens. The backing is then removed from the other side of the tape and the assembled reflector is placed into the grid over the lens, sealing the lens to the reflector. Once sealed it is virtually impossible for dust and insects to accumulate within the luminaire. It may be advantageous to provide the tape pre-installed either on the lip 22 or on the lens 42. Alternately instead of using tape, a Velcro type product can be used on the lens 42 or lip 22 and the loops attached to the opposite piece.

FIG. 12 shows how a nestable luminaire is adapted to use U-lamps. The ballasted-socket for U-lamps 158 has two integral straight-in bi-pin lamp holders 192 and two power receptacles 84 one on each end. The integral straight-in bi-pin lamp holders 192 are each provided with a ramp 150 and a recess 152. At the time of installation, the ballasted-socket for U-lamps 158 is inserted into aperture pair B 172. Aperture pair B is provided with relief slots 154 on each end of each of the apertures to permit the material used for the reflector to flex enough to permit the end of the ramp 150 to pass over it and lock this tab into recess 152, thus capturing the ballasted-socket for U-lamps 158 within aperture pair B 172. Lamp retaining clip 128 is inserted into lamp retaining clip slot 130 from underneath. U-lamp 160 is then inserted into the pair of straight-in bi-pin lamp holders 192 and held in place with lamp retaining clip 128. This assembly is placed into a ceiling grid preceded by optional lens 42. The power receptacle is then connected to a source of power.

FIG. 13 shows how a nestable luminaire is adapted for use with linear lamps. The ballasted-socket for linear lamps 138 has one integral bi-pin lamp holder 194 and one remote bi-pin lamp holder 142 plus two power receptacles 84. The integral bi-pin lamp holder 194 and the remote bi-pin lamp holder 142 are each provided with a ramp 150 and a recess 152. At the time of installation, the integral bi-pin lampholder 194 is inserted into one of the apertures A 170. Each aperture A 170 has a tab 196 associated with it to permit the material used for the reflector to flex enough to permit the end of the ramp 150 to pass through the aperture and lock the integral bi-pin lamp holder 194 of the ballasted-socket for linear lamps 138 within aperture A 170. In similar fashion, the remote bi-pin lamp holder 142 is inserted into the corresponding aperture A 170 opposite the aperture containing the integral bi-pin lamp holder 194. A linear lamp 148 is inserted into the lamp holders. This assembly is placed into a ceiling grid preceded by optional lens 42. The power receptacle is then connected to a source of power.

Summary—Third Related Family of Embodiments

The First and Second Related Family of Embodiments demonstrate how the nestable luminaire is capable of being nested one within another to minimize shipping volume. That approach is particularly desirable when large quantities of luminaries are being shipped and warehoused in bulk. The current embodiment addresses the situation where a single luminaire is packaged separately or a small number of luminaires are packaged together. In this embodiment, the reflector is flattened to minimize shipping and warehousing volume. For luminaires that use the ballasted-socket, the construction requirements in Underwriters' Laboratory standard UL 1570 that apply to conventional luminaires do not apply; therefore, the luminaire can be made of much lighter materials including plastic. In addition, the ballast-to-socket wiring is all contained in the ballasted-socket assembly. Thus, the luminaire merely supports the ballasted-socket and lamps, but does not need to protect any electrical wiring. Thus, the luminaire does not need to be constructed as rigidly as conventional luminaires.

Description—Third Related Family of Embodiments

Figure 14:
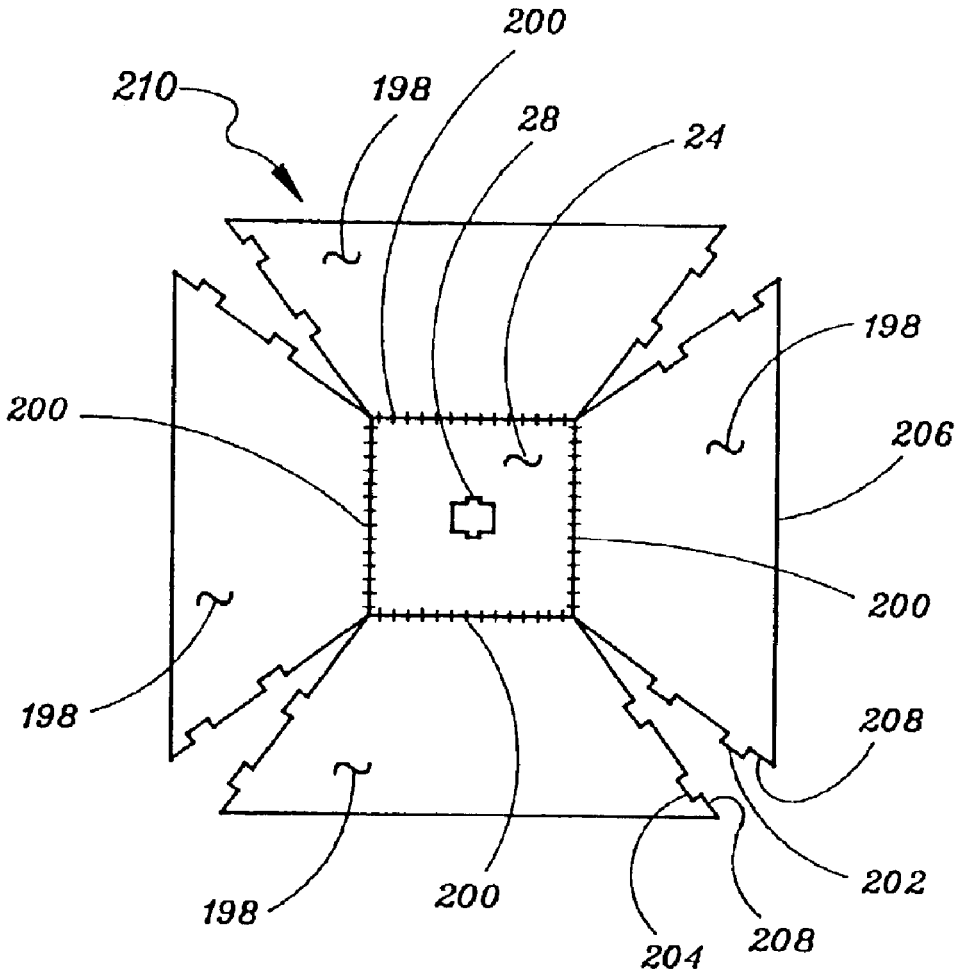
FIG. 14 shows a top view of the reflector of a flattenable luminaire in its flattened condition.

Shown in FIG. 14 is a top view of an example of a flattenable luminaire in its flattened state. Top plane 24 being approximately 10 inches by 10 inches. The top plane 24 is connected to four side panels 198 by way of four continuous hinges 200. The top plane 24 is provided with aperture 28. Each side panel 198 having interlocking notches 204 positioned such as to engage interlocking tabs 202 of its adjacent side panels during assembly. The outside edge 206 of the side panel 198 being slightly less than two feet in length. The adjoining edges 208 of the side panels 198 being approximately 11 inches in length.

This embodiment is particularly well suited for manufacture out of plastic material. The entire reflector can be stamped out of a single sheet of plastic or molded as a single piece. The continuous hinges 200 can be implemented as living hinges by reducing the thickness of the plastic along the outer edges of the top plane 24 along the line of intersection with the side panels 198.

Operation—Third Related Family of Embodiments

When the luminaire is installed, the side panels 198 of the flattenable luminaire reflector 210 are bent back inward until their adjoining edges 208 again meet. If the reflector is provided with interlocking tabs 202 and interlocking notches 204, the side panels 198 are snapped together. If the flattenable reflector 210 is not provided with the interlocking feature, the edges of the side panels are held closed using clamps or tape applied over each of the adjacent adjoining edges 208 on the back side of the flattenable reflector 210.

Once the flattenable reflector 210 is assembled, a ballasted-socket of the type described in previous embodiments is inserted into the flattenable luminaire reflector 210 and a lamp or lamps are plugged into the ballasted-socket. The assembled luminaire is then placed into the grid of a suspended ceiling. If an optional lens is used, it is merely placed into the grid before the reflector assembly.

The ballasted-sockets, lamps and lens can be shipped either packaged with the reflector or shipped separately in bulk.

Comments—Third Related Family of Embodiments

FIG. 14 shows interlocking tabs 202 and interlocking notches 204 on adjoining edges 208. These can be eliminated and the adjoining edges can be sealed with tape or held together with clamps. The truncated pyramid shape of the reflector shown in FIG. 14 is representative of the many shapes that can be implemented with the instant invention. For instance, there is no particular requirement that the side panels 198 be sloped as in the nestable embodiments described in previous embodiments. The side panels can be vertical if necessary and adjacent side panels do not need to be similarly shaped. It is only necessary that the adjoining edges have the same length. Consequently, any basic shape currently used for troffer type luminaires can be accommodated using this invention.

The aperture 28 shown in FIG. 14 accepts a ballasted-socket, which would be inserted from the rear of the reflector, and a lamp would then be inserted from the front of the luminaire as is shown in FIG. 3. The flattenable luminaire reflector can also accommodate the lamp and ballasted-socket arrangement depicted in FIG. 8 where one or more lamps can be installed and replaced from the rear of the luminaire. Using this configuration of ballasted-socket and lamps further allows the lens or diffuser to be attached to the front of the luminaire reflector to provide a sealed luminaire.

An example of an alternate way of implementing this embodiment is to slit the four edges that join the four side panels of the truncated pyramid of a reflector from a nestable luminaire, discussed in previous embodiments. The reflector is packaged with the top plane 24 forced down until it is coplanar with the side panels 198. The reflector is then shipped in this flattened condition. Upon removal from the packaging, the reflector will naturally try to assume, at least in part, its original shape.

Summary—Fourth Related Family of Embodiments

In commercial buildings and office buildings it is often required that the ceiling have a one hour or one and one-half hour fire rating. This means that the entire ceiling system is able to endure fire exposure for a given period in compliance with UL test conditions set out in standard ANSI/UL 263.

The nestable and flattenable luminaires described in the previous embodiments can be designed to be manufactured using very thin and lightweight metal or plastic. In commercial installations it may be required that the ceiling have a fire rating, which the lightweight luminaires would not be able to meet. As an alternative to using heavier gauge metal or high temperature plastic, in this invention a cover made out of the same or a material similar to the material used for the ceiling tiles, which do meet the fire rating requirements, is used.

Description—Fourth Related Family of Embodiments

Figure 15:
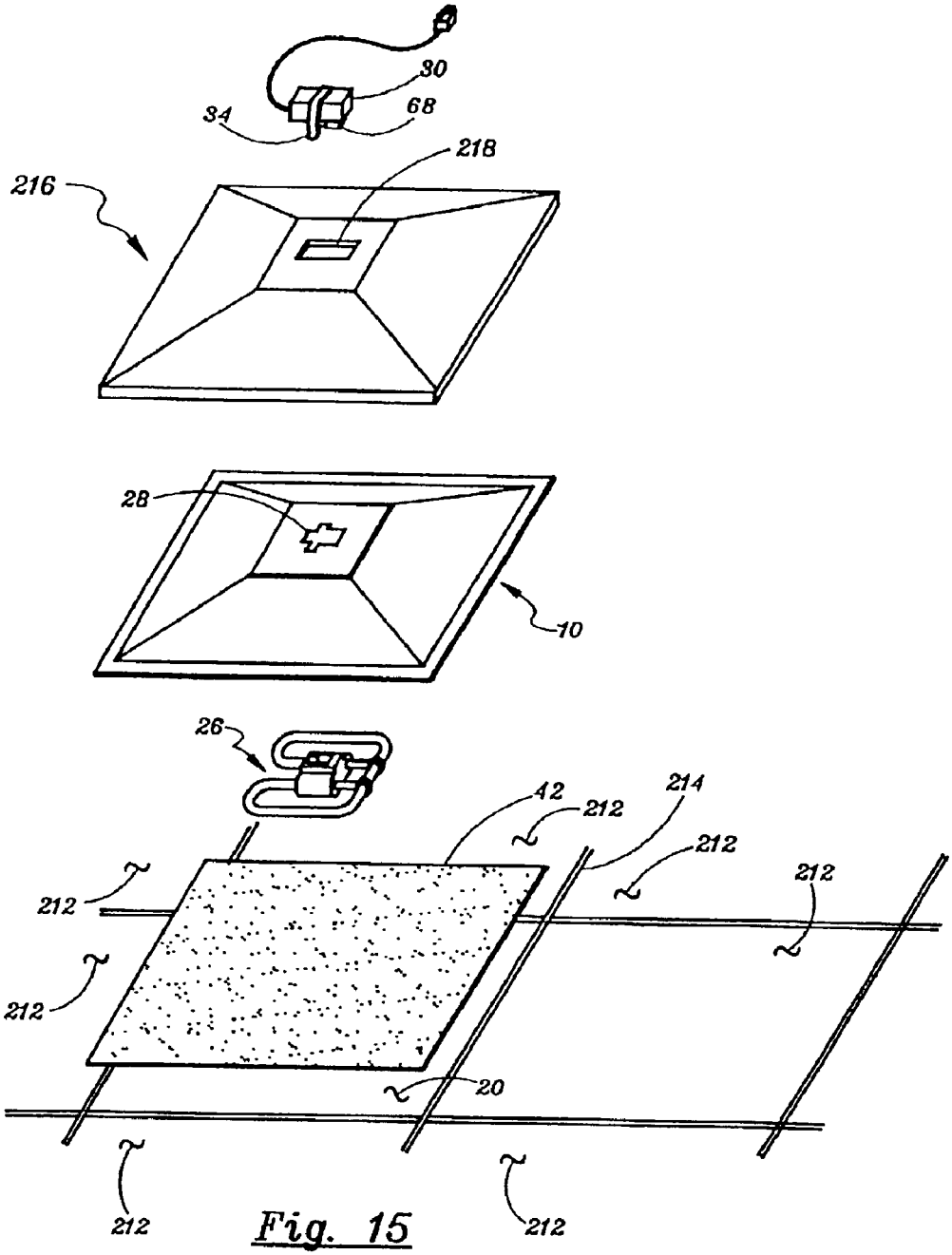
FIG. 15 shows how a fire rated cover can be added to a non-fire rated luminaire to improve the fire rating of the luminaire to match that of the rest of the ceiling.

FIG. 15 is an exploded view showing a fire-rated cover 216 added to a luminaire that is not fire-rated to increase the fire rating of the combination of luminaire and cover to match the fire rating of the rest of the ceiling. A fire-rated ceiling grid 214 is suspended a fixed distance above a floor in a room. Ceiling grid opening 20 being surrounded by ceiling grid openings containing fire-rated ceiling panels 212. Each fire-rated ceiling panel 212 measuring slightly less than two feet on each edge. The ceiling system consisting of fire-rated ceiling grid 214 and fire-rated ceiling panels 212, if used in all ceiling grid openings, constituting a UL fire-rated assembly. An optional 2' by 2' lens 42 being provided as a plastic diffuser or louvered assembly. 2D lamp 26 is typical of a lamp suitable for use with instant invention. A 2' by 2' luminaire reflector 10 typically made of plastic or light gauge metal as described in previous embodiments contains aperture 28 and is installed above 2' by 2' lens 42. Covering the 2' by 2' luminaire reflector 10 is a fire-rated luminaire cover 216, which measures slightly less than 2' by 2' at its base, so as, to allow it to fit into the grid opening 20. The fire-rated luminaire cover is manufactured from the same material, and is the same thickness as the fire-rated ceiling panels 212 (typically ⅝ inch). The fire-rated luminaire cover 216 contains fire-rated luminaire cover aperture 218. The fire-rated luminaire cover 216 having a shape of the internal surface, which basically conforms to the outside or back surface of the 2' by 2' luminaire reflector 10. Ballasted-socket assembly 30 is provided with four-pin lamp socket 68 and clip 34.

Figure 16:
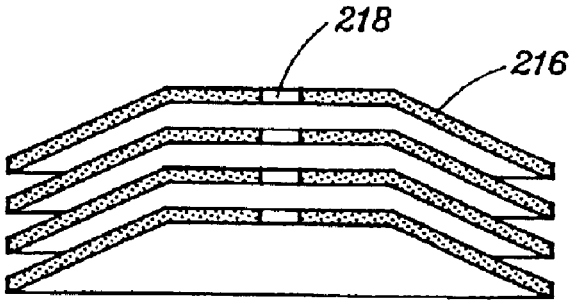
FIG. 16 shows a cross sectional view of a stack of typical fire rated luminaire covers.

FIG. 16 shows a cross sectional view of a stack of typical fire rated luminaire covers 216 with fire-rated luminaire cover aperture 218.

Operation—Fourth Related Family of Embodiment

FIG. 15 is typical of how a fire-rated luminaire cover is used with one of the examples of nestable luminaires described in prior embodiments. A fire-rated ceiling grid 214 is suspended from the permanent ceiling, floor support, or roof supports of a room. At regular intervals, 2' by 2' lenses are placed into the ceiling grid openings 20. A fire-rated luminaire cover 216 is positioned over a 2' by 2' luminaire reflector 10. Ballasted-socket assembly 30 is inserted through fire-rated luminaire cover aperture 218 and into aperture 28 of the 2' by 2' luminaire reflector 10, using clip 34 to hold it in place. 2D lamp 26 is then inserted into four-pin lamp socket 68. This assembly is placed into grid opening 20 over the 2' by 2' lens 42. The ballasted-socket is connected to a source of power as described in prior embodiments. Fire-rated ceiling panels 212 are placed into the ceiling grid openings 20 that do not contain luminaires. Since the fire-rated luminaire cover is made of the same material as the fire-rated ceiling panels 212 or a material with a superior fire rating compared to the fire-rated ceiling panels 212, the whole ceiling system can be fire rated, even though the 2' by 2' luminaire reflector 10 is made of a material that would not pass the ANSI/UL 263 test without the additional protection of the fire-rated luminaire cover 216. A further benefit of using the fire-rated luminaire cover 216 is that the combined weight of the luminaire reflector 10, fire-rated luminaire reflector cover 216, the ballasted-socket assembly 30, and the 2D lamp 26 result in a weight greater than 1 pound per square foot, eliminating the need for hold down clips on the luminaire that would be required for luminaires weighing less than 1 pound per square foot.

FIG. 15 shows the fire-rated luminaire cover 216 as separate item from the luminaire reflector 10. This approach allows flexibility in that the same luminaire reflector 10 can be used in locations that need a fire-rated ceiling system as well as those location that do not. Under certain circumstances it may be desirable to provide the fire-rated luminaire cover 216 as an integral part of the luminaire reflector 10 by precisely matching the shape of the back of the luminaire reflector 10 to the front side of the fire-rated luminaire cover 216 and bonding the two pieces together.

FIG. 16 shows a cross sectional view of several fire-rated luminaire covers 216 demonstrating how fire-rated luminaire covers designed for nestable or flattenable luminaire reflectors can themselves be nested to save shipping volume.

Since in most cases the material used for the 2' by 2' luminaire reflector 10 will need to have a flame rating of only 94 HB to meet UL listing requirements under UL1570, the material will provide an additional source of heat in the proximate vicinity of the fire-rated luminaire cover 216, the thickness of the cover may need to be increased slightly over the thickness of the fire-rated ceiling panels 212. The FIG. 15 shows the luminaire cover being used with a luminaire reflector of what has been previously described as a nestable luminaire. This invention will work equally well with a flattenable luminaire reflector and will work with luminaires, which are neither nestable nor flattenable.

An alternative embodiment of the instant invention uses the flattenable approach described in a previous embodiment as applied to the luminaire reflector. Instead of using a single molded part, which has the same general shape as the luminaire, the fire-rated luminaire cover is fabricated out of five separate pieces of fire-rated ceiling tile material. One piece for the top plane and four identical pieces to make up the four sides of the truncated pyramid of the fire-rated luminaire cover 216 depicted in FIG. 15. Each of the five pieces having mitered edges and laminated at least at its adjoining edges to a flexible member to act as a continuous hinge. The assembly so arranged to allow it to be shipped with all five panels lying in the same plane and to permit each of the four sides to be folded inward an equal amount to assume the shape of the truncated pyramid. This assembly is then used in the same manner as discussed previously for the molded fire-rated luminaire cover 216. In the case of the flattenable luminaire described in the third embodiment of this specification, the fire-rated ceiling tile material can be attached directly to the five panels of the flattenable luminaire.

Comments—Fourth Related Family of Embodiment

Although the description above describes the application of the fire-rated luminaire cover in terms of nestable and flattenable luminaires, the invention also applies to luminaires, which are not nestable or flattenable. The fire-rated luminaire cover is described as a separate unit which is placed over a separate luminaire, but a fire-rated luminaire can be constructed by lining the back side of a luminaire made out of light-weight reflective material with fire-rated ceiling tile material.

Referring to FIG. 15, in its most basic form the fire-rated luminaire cover 216 can be used as the luminaire reflector directly without the need for a separate plastic or metal luminaire reflector 10. This can be accomplished by merely reinforcing the area around the fire-rated luminaire cover aperture 218, which engages the clip 34 of the ballasted-socket assembly 30 with a harder material such as a thin sheet of plastic or metal. In this embodiment the inside surface of the fire-rated luminaire cover (the side facing the floor when installed) is coated with a highly reflective coating often used on modern ceiling tile or coated with a thin plastic or metal coating to increase reflectivity as well as durability.

Conclusions, Ramifications, and Scope

Accordingly, it can be seen that the invention provides a dramatic reduction in the cost to manufacture, ship and store luminaires. In addition, substantial savings in the cost of installation are achieved since the luminaires can easily be assembled, installed and connected to the power source by non-skilled, non-electrician installers.

Although the description above contains many specificities, these should not be construed as limiting the scope of the invention but as merely providing illustrations of some of the presently preferred embodiments of this invention. Various other embodiments and ramifications are possible within it's scope. For example, although the specification describes the nestable and flattenable luminaire with a ballasted-socket designed for a class II or class III high-frequency power input, the nestable luminaire concept can also be used with non-class II or III, AC and DC circuits. The ballasted-socket in these situations would merely have to enclose all non-class II and III circuits and wiring, while the input connection would have to meet the local codes that may apply.

The specification shows and describes the ballasted-socket being mounted through an aperture from the rear of the luminaire. This technique generally allows the lamp to be mounted more closely to the top plane of the luminaire, but the ballasted-socket can be designed to be mounted within and from the front of the luminaire as well. The specification also discusses the field assembly of the nestable luminaire and how the ballasted-socket is clipped into the luminaire's reflector, much of the reduction of the in shipping volume can still be achieved with the ballasted socket already mounted in the reflector prior to shipment.

While the specification discusses the use of plastic for the reflector material, under certain circumstances it will be advantageous to use other materials, such as metal, fiberglass, etc. The figures show the shape of the reflector to be a truncated pyramid, but any structural shape that will function as a reflector and allow one reflector to be nested within another for shipping purposes is suitable for this purpose. The optics may be improved by making the sides curved instead of flat and by using different angles for the slopes of the sides. The specification is presented in terms of 2'X2' and 2'X4' luminaires. While these luminaires are currently the most common, the invention works equally well for other sizes as well.

The various types of lamps require different ballasted-sockets, which in turn require different mounting apertures. In an effort to minimize the number of different reflectors that are needed to accommodate the various lamp types, the same reflector can be manufactured with the material of the reflector made thinner at the outline of the various apertures. In this way, the same reflector can be used for several different lamp types by merely knocking out the material of the appropriate aperture.

The fire-rated luminaire cover is described in the above specification using the 2D lamp as an example, the invention clearly is applicable to luminaires that use other single-ended lamps, linear lamps, U-lamps, etc.

Thus, the scope of the invention should be determined by the appended claims and their legal equivalents, rather than by the examples given.

Definitions luminaire: a complete lighting unit consisting of a lamp or lamps together with the parts designed to distribute the light, to position and protect the lamps, and to connect and interface the lamps to the power source.

troffer: a recessed lighting unit, installed with the opening flush with the ceiling.

compact fluorescent lamps: single-ended fluorescent lamps such as, Biax, double Biax, triple Biax, quad Biax, flat, helical, spring, etc.

high-frequency: frequencies greater than 10 kHz.

I claim:

1. A luminaire for a ceiling comprising:

a reflector having a tapered side wall or walls which allow it to be stacked on top of an identical reflector, such that, the total height of the two nested reflectors is less than 50% taller than the height of a single reflector, the reflector having at least one aperture for the insertion of a ballasted-socket assembly; and a ballasted-socket assembly comprising: a power input connection, ballasting circuitry to properly power a gas-discharge lamp, a gas-discharge lamp socket, and an enclosure that contains and completely encloses: said ballasting circuitry, the connections to said gas-discharge lamp socket, and the interconnection between the output of said ballasting circuitry and said gas-discharge lamp socket; and a gas-discharge lamp.

2. The luminaire recited in claim 1, wherein the ballasted-socket assembly is connected to and powered from a power source;

said power source having an output which is limited to 250 volt-amperes or less.

3. The luminaire recited in claim 1, wherein the ballasted-socket assembly is connected to and powered from an output of a power source;

said output being turned off for at least 90% of the time if the current drawn from the output exceeds a predetermined limit while said output is turned on.

4. The luminaire recited in claim 1, wherein the ballasted-socket assembly is connected to the wiring from the power source using an insulation displacement connection.

5. The luminaire recited in claim 1, wherein the ballasted-socket assembly is disconnectably connected to a power source using a power plug.

6. The luminaire recited in claim 1, wherein the reflector is non-metallic.

7. The luminaire recited in claim 1, wherein the reflective side of the reflector includes a textured surface.

8. The luminaire recited in claim 1, wherein the power input connection is connected to a source of high-frequency power.

9. The luminaire recited in claim 1, wherein the ballasted-socket assembly clips or snaps into the reflector aperture.

10. The luminaire recited in claim 1, wherein the ballasted-socket assembly is inserted into said aperture and then rotated in order to affix it to the reflector.

11. The luminaire recited in claim 1, wherein the luminaire contains multiple gas-discharge lamps.

12. The luminaire recited in claim 1, wherein the luminaire is so constructed to permit relamping from the back or the side of the luminaire.

13. The luminaire recited in claim 12, wherein the luminaire is provided with a lens that is permanently affixable to the luminaire during field assembly.

14. The luminaire recited in claim 1, wherein the luminaire is a troffer.

15. The luminaire recited in claim 1, wherein power is provided by a power-limited voltage source.

16. The luminaire recited in claim 1, wherein power is provided by a voltage with an rms magnitude less than 60 volts.

17. The luminaire recited in claim 1, wherein power is provided by a voltage with an rms magnitude less than 150 volts.

18. A structural element adapted for mounting in a ceiling wherein said structural element: (i) is operable as a reflector for a light source providing illumination for the space below said ceiling, (ii) has an aperture to permit the mounting of a receptacle operable to make electrical connection to a power source and to receive, provide connection to and hold an electric lamp, (iii) has a certain height, (iv) is of such a shape as to permit one such structural element to be nested within another such that two such elements, when so nested, will exhibit a combined height no more than 50 per cent higher than said certain height.

19. The structural element recited in claim 18, wherein said electrical connection is to a power source having an output current that is limited to a value is less than 2.5 amps rms and a voltage that is less than 60 volts rms.

20. The structural element recited in claim 18, wherein said electrical connection is to a power source having an output current that is limited to a value that is less than 2.5 amps rms and a voltage that is less than 150 volts rms.

21. The structural element recited in claim 18, wherein the receptacle is connected to the wiring from the power source using an insulation displacement connection.

22. The structural element recited in claim 18, wherein said electrical connection is made using plug-in connectors.

23. The structural element recited in claim 18, wherein said structural element is non-metallic.

24. The structural element recited in claim 18, wherein the reflective side of said structural element includes a textured surface.

25. The structural element recited in claim 18, wherein a lens is placed between the ceiling and said structural element.

26. The structural element recited in claim 18, wherein said receptacle clips or snaps into the aperture.

27. The structural element recited in claim 18, wherein said receptacle must be placed into said aperture and then rotated in order to affix it to the structural element.

28. The structural element recited in claim 18, wherein said structural element contains multiple electric lamps.

29. The structural element recited in claim 18, wherein said structural element is constructed to permit relamping from the back or the side of said structural element.

30. The structural element recited in claim 18, wherein the structural element is provided with a lens that is permanently affixed to the structural element during field assembly.

31. The structural element recited in claim 18 wherein said electrical connection is made to a source of voltage and the structural element is used as a troffer.

32. The structural element recited in claim 18, wherein the structural element is used as a troffer.

33. The structural element recited in claim 18 wherein said electrical connection is made to a source of power limited voltage.

34. The structural element recited in claim 18, wherein said electrical connection is made to a source of power;

said source of power having an output current that is limited to a value that is less than 2.5 amps rms and a voltage that is less than 60 volts rms.

35. The structural element recited in claim 18, wherein said electrical connection is made to a source of high-frequency power;

said source of high-frequency power having an output current that is limited to a value that is less than 2.5 amps rms and a voltage that is less than 150 volts rms.

36. A field assembled luminaire for a ceiling comprising:

a ballasted-socket assembly for compact fluorescent and other single-ended gas-discharge lamps;

said ballasted-socket assembly including: a power input connection, ballasting circuitry to properly power a gas-discharge lamp, a lamp socket adapted to receive and hold such a lamp, and an enclosure that contains and completely encloses: said ballasting circuitry, the connections to said lamp socket, and the interconnection between the output of said ballasting circuitry and said lamp socket;

said enclosure not including a gas-discharge lamp;

a reflector which is supported by the ceiling;

said reflector capable of receiving said ballasted-socket assembly; and a gas-discharge lamp.

37. A luminaire for a ceiling;

said luminaire having a gas-discharge lamp, a lens, and a reflector;

said lens permanently attached to said reflector at the time of luminaire installation.

38. The luminaire recited in claim 37 wherein, said permanent attachment being accomplished with adhesively coated gasket material that is provided as part of the reflector or lens.

39. The luminaire recited in claim 37 wherein, said lamp is replaced from the rear of the luminaire.

40. A luminaire for a ceiling comprising: a lamp, a reflector and a ballasting circuit with an integral lamp socket;

said ballasting circuit with integral lamp socket, lamp, and reflector each shipped separately; and said luminaire is assembled at the time of installation into the ceiling.

41. A functional luminaire for a ceiling comprising: a connection to a source of power, a lamp socket, a lamp, a reflector, ballasting circuitry and an enclosure;

said enclosure completely enclosing the ballasting circuitry and the connections to the lamp socket;

said luminaire being supplied with no output wiring to the lamp existing outside of said enclosure;

said enclosure not enclosing the lamp.

42. A ballasted-socket assembly comprising: a power input connection suitable for connection to a source of power, ballasting circuitry to properly power a gas-discharge lamp, a gas-discharge lamp socket, and an enclosure;

said enclosure containing and completely enclosing: said ballasting circuitry, the connections to said gas-discharge lamp socket, and the interconnection between the output of said ballasting circuitry and said gas-discharge lamp socket;

said enclosure not containing or completely enclosing a gas-discharge lamp.

43. A combination comprising:

the assembly described in claim 42; and a source of voltage, said source of voltage having its output power limited to 250 volt-amperes or less.

44. The assembly described in claim 42, wherein the power input connection is provided via an integral power cable;

said power cable having a power plug;

the power plug having two or more plug terminals;

the assembly including a power receptacle;

the power receptacle having two or more receptacle terminals; each receptacle terminal being electrically connected to a corresponding plug terminal.

45. The assembly described in claim 42, wherein the input power is provide via either of two parallel connected power receptacles.

46. The assembly described in claim 42, wherein the bulk of the ballasted-socket assembly is designed to be located external to the luminaire;

said ballasted-socket assembly being a separately packaged assembly that does not contain an inverter.

47. The assembly described in claim 42, wherein said ballasted-socket assembly is used in combination with a luminaire for installation into a ceiling;

said luminaire having a reflector;

said reflector being of such shape to allow a second reflector to be stacked on top of the first reflector;

the two reflectors when so stacked having a combined height no more than 50% higher than that of a single reflector.

48. The assembly described in claim 42, wherein the ballasted-socket assembly does not contain an electronic inverter circuit.

49. A ballasted-socket assembly comprising: a power input connection suitable for connection to a source of electrical power, ballasting circuitry to properly power a gas-discharge lamp, lamp socket, an enclosure and a cover plate;

said enclosure containing and completely enclosing: said ballasting circuitry, the connections to said lamp socket, and the interconnection between output of said ballasting circuitry and said lamp socket;

said enclosure not containing or completely enclosing a gas-discharge lamp.

50. The assembly described in claim 49, wherein said enclosure is formed at least in part by the cover plate.

51. The assembly described in claim 49, wherein the power input connection is provided via an integral power cable;

said power cable having a power plug;

the power plug having two or more plug terminals;

the assembly including a power receptacle;

the power receptacle having two or more receptacle terminals;

each receptacle terminal being electrically connected to a corresponding plug terminal.

52. The assembly described in claim 49, wherein the input power is provided via either of two parallel connected receptacles.

53. The assembly described in claim 49, wherein the bulk of the ballasted-socket assembly is located external to the luminaire;

said ballasted-socket assembly being a separately packaged assembly that does not contain an inverter.

54. The assembly described in claim 49, wherein the cover plate makes up part of said enclosure;

the assembly being provided with a gas-discharge lamp;

said cover plate removably mounted to the outside of a reflector;

the cover plate when so mounted providing access for the replacement of said gas-discharge lamp.

55. The assembly described in claim 49, wherein the ballasted-socket assembly does not contain an electronic inverter circuit.

56. A ceiling including:

a plurality of luminaires;

said luminaires suitable for placement directly into the openings of said ceiling;

said luminaire having a reflector with a certain shape;

said certain shape allowing one reflector to be nested within another reflector;

the combined height of two nested reflectors being no higher than 1.9 times the height of a single reflector;

said luminaire being provided with a ballasted-socket assembly;

said ballasted-socket assembly having an enclosure; and said ballasted-socket assembly containing all electrical components required to power an electric lamp.

57. The luminaire recited in claim 56 wherein the reflector has a top plane;

the reflector being constructed to permit the luminaire to accommodate a lamp that has a total length that is greater than the length of the top plane of the luminaire.

58. The luminaire recited in claim 56 wherein the reflector contains an aperture;

said aperture being capable of receiving a ballasted-socket assembly;

said ballasted-socket assembly including a recess; and said recess being capable of engaging an edge of the aperture for the purpose of retaining the ballasted-socket.

59. The luminaire recited in claim 56 wherein the reflector contains apertures;

one of said apertures being capable of receiving a ballasted-socket assembly;

said ballasted-socket assembly including a remote bi-pin lampholder;

a second aperture being capable of receiving a remote bi-pin lampholder;

one side of each said aperture being a flexible member; and said flexible member being capable of moving sufficiently to permit a standard length linear lamp to be inserted within the lampholders of the ballasted-socket.

60. A structural element adapted for mounting in an opening in a ceiling wherein the structural element: (i) is operable as a reflector for a light source providing illumination for the space below said ceiling, (ii) has an aperture to permit the mounting of a receptacle operable to receive, provide electrical connection to, contain all electronic components required to properly power and hold an electric lamp, (iii) has a certain height, and (iv) is of such a shape as to permit one such structural element to be nested within another, such that two such elements, when so nested, will exhibit a combined height no more than 1.9 times said certain height.

61. The structural element recited in claim 60, wherein said electrical connection is to an energy limited circuit; and said limit being less than 250 volt-amperes.

62. The structural element recited in claim 60, wherein a lens is placed between the ceiling and said structural element.

63. The structural element recited in claim 60, wherein said structural element is constructed to permit relamping from the back or the side of said structural element.

64. The structural element recited in claim 60, wherein the structural element is provided with a lens that is permanently affixed to the structural element during field assembly.

65. The structural element recited in claim 60 wherein said electrical connection is made to a source of high-frequency AC voltage.

66. A module suitable for receiving voltage on its power input terminals and properly powering a lamp connected to its output terminals;

said output terminals being contained in one or more lamp sockets or lampholders;

said module having an enclosure;

said enclosure completely enclosing all circuitry, connections to lamp sockets or lampholders, and internal wiring between the circuitry and the lamp sockets or lampholders;

said enclosure not enclosing lamp; and said circuitry not being enclosed in a separate additional enclosure required to provide protection from fire or shock hazard.

67. The module recited in claim 66 wherein the module contains a single circuit connected to multiple lamp sockets; and each lamp socket being capable of powering a single lamp.

68. The module recited in claim 66 wherein the module has multiple lamp sockets;

a given lamp requiring connection to two lamp sockets to be properly powered.

69. A module suitable for receiving voltage on its power input terminals and properly powering a lamp connected to its output terminals;

said output terminals being contained in two or more lamp sockets or lampholders;

said module having an enclosure;

said enclosure completely enclosing all circuitry, connections to at least one lamp socket or lampholder, and the internal wiring between the circuitry and said lamp socket or lampholder;

said enclosure not enclosing any lamp;

said circuitry not being enclosed in a separate additional enclosure required to provide protection from fire or shock hazard;

said module having a second lamp socket or lampholder; and said second lamp socket or lampholder being connected to the module by one or more conductors.

70. The module disclosed in claim 69 wherein two separate lampholders are required to properly power a given lamp;

the second lamp socket or lampholder being connected to the module with more than one conductor;

the conductors having an electrical voltage between them; and said voltage between any two conductors being at all times less than 30 volts.

71. The module disclosed in claim 69 wherein two separate lampholders are required to properly power a given lamp;

said lamp having lamp terminals;

both lampholders having openings to receive said lamp terminals; and said module so constructed to provide said openings facing the same direction.

72. The module disclosed in claim 69 wherein two separate lampholders are required to properly power a given lamp;

said lamp having lamp terminals;

both lampholders having openings to receive said lamp terminals; and said module so constructed to provide said openings facing opposite directions.

73. A luminaire for a ceiling;

said luminaire having a reflector;

said reflector including multiple apertures to accommodate one or more ballasted-socket assemblies;

said different types of ballasted-socket assemblies possessing different physical shapes and configurations to accommodate a variety of gas discharge lamps; and said apertures being of various shapes to permit said reflector to be used with more than one type of ballasted-socket assembly.

74. The luminaire recited in claim 73 wherein the apertures in the reflector are not open;

position of said apertures being indicated by having at least the perimeter of the aperture formed by the material of the reflector being at least 10% thinner than the material of the reflector adjacent to the outline of the aperture; and the reduction in material thickness around the perimeter of the aperture allowing the material within the perimeter to be dislodged from the reflector if said aperture is used for the insertion of a ballasted-socket assembly.

75. The luminaire recited in claim 73 wherein the aperture of the reflector is not open;

the aperture having a perimeter; and said perimeter being sheared or partially sheared to allow the material within the aperture to be dislocated from the reflector if said aperture is used for the insertion of a ballasted-socket assembly.

76. A module;

said module having an input connection comprising two conductors;

said module having multiple output connections;

the multiple output connections being incorporated within one or more sockets;

the socket being so constructed to prevent the possibility of human contact directly with any of the output conductors;

the module containing a ballasting circuit capable of properly ballasting a gas discharge lamp, but only when the conductors of the input connection are connected to a voltage source;

said voltage source having a frequency of 0 to 25 Hertz or greater than 400 Hertz;

said module including an enclosure;

the enclosure completely enclosing the ballasting circuit, and the electrical connections to the socket; and said enclosure not enclosing any lamp.

77. The module recited in claim 76, wherein the ballasting circuit comprises only passive components.

78. The module recited in claim 76, wherein the ballasting circuit does not include a high frequency inverter.

79. The module recited in claim 76, wherein the module includes lamp sockets for linear fluorescent lamps.

80. The module recited in claim 76, wherein the module is used in combination with a reflector of a luminaire;

the module being mounted onto the reflector of a luminaire such that more than 50% of the volume of the module is external to the luminaire.

81. The module recited in claim 76, wherein the module is used in combination with a reflector of a luminaire;

the module being mounted onto the reflector of a luminaire such that more than 50% of the volume of the module is internal to the luminaire.

82. The module recited in claim 76, wherein the voltage source is DC.

83. A structural element for installation into a ceiling;

the structural element having a reflector;

said reflector having four hinged panels;

each of the hinged panels being connected to a different edge of a common rectangular panel via a hinge;

the structural element being further characterized by: (i) being operable as a reflector for a light source providing illumination for the space below said ceiling, (ii) having an aperture to permit the mounting of a receptacle operable to receive, provide electrical connection to and hold an electric lamp, (iii) having a certain height immediately prior to being mounted in said ceiling, and (iv) being of such construction as to permit the height during shipment to be substantially less than said certain height.

84. The structural element recited in claim 83, wherein a non-hinged lens is placed between the ceiling and said structural element.

85. The structural element recited in claim 83, wherein the height during shipment is less than 25% of said certain height immediately prior to being mounted in said ceiling.

86. The structural element recited in claim 83, wherein said electric lamp is replaceable;

said electric lamp is fluorescent; and the structural element is provided with a lens that is permanently affixed to the structural element during field assembly.

87. The structural element recited in claim 83, wherein said receptacle is a separate self-contained assembly that is removable from said structural element.

88. The structural element recited in claim 83, wherein said hinged panels are substantially trapezoidal in shape.

89. The structural element recited in claim 83, wherein two of the hinged panels are rectangular and two of the hinged panels are trapezoidal.

90. The structural element recited in claim 83, wherein the structural element has adjoining edges;

said adjoining edges having a gap separating one from the other at some time prior to installation; and said gap being substantially reduced prior to installation into the ceiling.

91. The structural element recited in claim 83, wherein said hinged panels are substantially trapezoidal in shape.

92. A luminaire for a ceiling comprising:

a reflector having at least one aperture for the attachment of a ballasted-socket assembly;

said reflector having four hinged panels;

each of the hinged panels being connected to a different edge of a common rectangular panel via a hinge;

said reflector having a certain height immediately prior to being installed into the ceiling;

said certain height being substantially greater than the height of the reflector during shipment;

a ballasted-socket assembly comprising: a power input connection, ballasting circuitry to properly power a gas-discharge lamp, a gas-discharge lamp socket, and an enclosure that contains and completely encloses: said ballasting circuitry, the connections to said gas-discharge lamp socket, and the interconnection between the output of said ballasting circuitry and said gas-discharge lamp socket; and a gas-discharge lamp.

93. The luminaire recited in claim 92, wherein said hinged panels are substantially rectangular in shape.

94. The luminaire recited in claim 92, wherein a non-hinged lens is placed between the ceiling grid and the reflector.

95. The luminaire recited in claim 94, wherein said gas-discharge lamp is replaceable; and the luminaire is provided with a lens that is permanently affixed to the luminaire during field assembly.

96. The luminaire recited in claim 92, wherein said certain height immediately prior to being mounted into the ceiling is 25%, or more, greater than the height of the reflector during shipment.

97. The luminaire recited in claim 92, wherein said hinged panels are substantially trapezoidal in shape.

98. A field assembled luminaire for a ceiling comprising:

a ballasted-socket assembly for a gas-discharge lamp;

said ballasted-socket assembly including: a power input connection, ballasting circuitry to properly power a gas-discharge lamp, a lamp socket adapted to receive and hold such a lamp, and an enclosure that contains and completely encloses: said ballasting circuitry, the connections to said lamp socket, and the interconnection between the output of said ballasting circuitry and said lamp socket;

a reflector which is supported by a ceiling grid system;

said reflector having four hinged panels;

each of the hinged panels being connected to a different edge of a common rectangular panel via a hinge;

said reflector having a certain height immediately prior to installation into the ceiling grid system;

said reflector having a height during shipment substantially less than said certain height;

said reflector capable of receiving said ballasted-socket assembly;

a gas-discharge lamp; and said enclosure included in the ballasted-socket assembly not enclosing the gas-discharge lamp.

99. The luminaire recited in claim 98, wherein said hinged panels are substantially rectangular in shape.

100. The luminaire recited in claim 98, wherein two of the hinged panels are rectangular and two of the hinged panels are trapezoidal.

101. The luminaire recited in claim 98, wherein height reduction during shipment is greater than 50%.

102. A ceiling including:

a plurality of openings;

a plurality of luminaires;

said luminaires suitable for placement into the openings of said ceiling;

said luminaire having a reflector;

said reflector having four hinged panels;

each of the hinged panels being connected to a different edge of a common rectangular panel via a hinge;

said reflector having a certain height immediately prior to installation into the rectangular grid opening; and said reflector having a height during shipment substantially less than said certain height.

* * * * *